US011054151B2

(12) United States Patent
Bai et al.

(10) Patent No.: US 11,054,151 B2
(45) Date of Patent: Jul. 6, 2021

(54) INDOOR UNIT FOR AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Xiaofeng Bai, Foshan (CN); Dacheng Li, Foshan (CN); Xing Liu, Foshan (CN); Xinzhou Zhang, Foshan (CN); Jianjian Zhang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 777 days.

(21) Appl. No.: 15/323,308

(22) PCT Filed: Mar. 31, 2015

(86) PCT No.: PCT/CN2015/075634
§ 371 (c)(1),
(2) Date: Dec. 30, 2016

(87) PCT Pub. No.: WO2016/154954
PCT Pub. Date: Oct. 6, 2016

(65) Prior Publication Data

US 2017/0138613 A1 May 18, 2017

(51) Int. Cl.
*F24F 1/0007* (2019.01)
*F24F 1/0057* (2019.01)
(Continued)

(52) U.S. Cl.
CPC ..... *F24F 1/0007* (2013.01); *F24F 1/0025* (2013.01); *F24F 1/0057* (2019.02);
(Continued)

(58) Field of Classification Search
CPC combination set(s) only.
See application file for complete search history.

(56) References Cited

U.S. PATENT DOCUMENTS 5,575,326 A 11/1996 Asami et al.
2011/0048050 A1* 3/2011 Moteki ..... F24F 1/0007 62/263
2011/0314855 A1 12/2011 Yu et al.

FOREIGN PATENT DOCUMENTS

CN 1786594 6/2006
CN 102374630 3/2012
(Continued)

OTHER PUBLICATIONS

JPH08135994A_MT, Machine Translation of JPH08135994A (Year: 1996).*
(Continued)

*Primary Examiner* — Steven B McAllister
*Assistant Examiner* — Elizabeth M. May
(74) *Attorney, Agent, or Firm* — Anova Law Group PLLC

(57) ABSTRACT

An indoor unit (1000) for an air conditioner is provided. The indoor unit (1000) includes a housing (100) having an upper base plate (110) provided with an air inlet (101), a lower base plate (120) detachably mounted to the upper base plate (110) and provided with an air outlet, and a front cover (130) detachably mounted to the upper base plate (110); a heat exchanger (140) mounted to the upper base plate (110); and a fan (142) detachably mounted to the lower base plate.

26 Claims, 21 Drawing Sheets

(51) Int. Cl.
*F24F 13/20* (2006.01)
*F24F 1/0025* (2019.01)
*F24F 13/30* (2006.01)

(52) U.S. Cl.
CPC ..... *F24F 13/20* (2013.01); *F24F 13/30* (2013.01); *F24F 2013/205* (2013.01); *F24F 2221/22* (2013.01); *F24F 2221/26* (2013.01)

(56) References Cited

FOREIGN PATENT DOCUMENTS

| | | | | |
|---|---|---|---|---|
| CN | 102472508 | A | | 5/2012 |
| CN | 103994562 | | | 8/2014 |
| CN | 104422026 | A | | 3/2015 |
| CN | 104748238 | A | | 7/2015 |
| CN | 104748241 | A | | 7/2015 |
| CN | 104748344 | A | | 7/2015 |
| CN | 204629734 | U | | 9/2015 |
| CN | 204629963 | U | | 9/2015 |
| CN | 204786752 | U | | 11/2015 |
| EP | 2299193 | | | 3/2011 |
| EP | 2409088 | | | 1/2012 |
| EP | 2749823 | | | 7/2014 |
| JP | 08135994 | A | * | 5/1996 |
| JP | H10141693 | | | 5/1998 |
| JP | 2001221497 | A | | 8/2001 |
| JP | 2004020151 | | | 1/2004 |
| JP | 2004020151 | A | | 1/2004 |
| JP | 2004190991 | A | | 7/2004 |

OTHER PUBLICATIONS

APO, Office Action for AU Application No. 2015388527, dated Dec. 6, 2017.

ISA/CN, International Search Report for PCT/CN2015/075634.

EPO, Office Action for EP Application No. 15886924, dated Oct. 22, 2018.

Intellectual Property Corporation of Malaysia The Substantive Examination Adverse Report and Search Report for Malaysia Application No. PI2016704864 dated May 21, 2020 4 Pages.

* cited by examiner

K

INDOOR UNIT FOR AIR CONDITIONER

RELATED APPLICATIONS

This U.S. application claims priority under 35 U.S.C 371 to, and is a U.S. National Phase application of, the International Patent Application No. PCT/CN2015/075634, filed on Mar. 31, 2015. The entire contents of the before-mentioned patent applications are incorporated by reference as part of the disclosure of this U.S. application.

FIELD

The present invention relates to a field of household appliances, and more particularly to an indoor unit for an air conditioner.

BACKGROUND

An indoor unit in the prior art has a housing, and the housing includes a base plate, a face frame mounted to the base plate, and a panel mounted to the face frame. A heat exchanger and a fan are mounted to the base plate, and a fan wheel of the fan is located at an inner side of the heat exchanger. Even though the face frame is dismounted, the fan wheel cannot be dismounted only if the heat exchanger is also dismounted, because the fan wheel is limited by the heat exchanger and the base plate together, which brings about great inconvenience to a user. The dismounting and cleaning of the fan wheel needs professional help, which results in a high cost.

SUMMARY

The present invention aims to solve at least one of the problems existing in the related art. Thus, embodiments of the present invention provide an indoor unit for an air conditioner. It is convenient to assemble and disassemble a fan of the indoor unit.

According to the embodiments of the present invention, the indoor unit includes: a housing having an upper base plate provided with an air inlet, a lower base plate detachably mounted to the upper base plate and provided with an air outlet, and a front cover detachably mounted to the upper base plate; a heat exchanger mounted to the upper base plate; and a fan detachably mounted to the lower base plate.

In the indoor unit according to the embodiments of the present invention, the fan is mounted to the lower base plate and the lower base plate is detachably mounted to the upper base plate, such that the cleaning, maintenance and repair of the fan just need to dismount the lower base plate from the upper base plate, and hence the fan may be dismounted from the indoor unit, which avoids a problem in the prior art that the heat exchanger affects the mounting and dismounting of the fan. The convenient dismounting of the fan in the present invention facilitates cleaning a fan wheel of the fan. The cleaning of the fan wheel does not involve the dismounting and mounting of the heat exchanger, which thus avoids a problem that the heat exchanger tends to break down due to the dismounting and mounting thereof, thereby facilitating the maintenance of the indoor unit and reducing the failure rate of the indoor unit.

In an embodiment of the present invention, the upper base plate includes: a rear baffle, the heat exchanger being disposed to the rear baffle; an upper cover plate having a rear edge connected with an upper edge of the rear baffle, the air inlet being formed in the upper cover plate; a left end plate having a rear edge connected with a left edge of the rear baffle and an upper edge connected with a left edge of the upper cover plate; and a right end plate having a rear edge connected with a right edge of the rear baffle and an upper edge connected with a right edge of the upper cover plate. The lower base plate is detachably mounted at a right side of the left end plate and at a left side of the right end plate, the left end plate is located at a left side of the lower base plate, and the right end plate is located at a right side thereof.

In an embodiment of the present invention, the upper base plate further includes: a left shield plate mounted at a left side of the left end plate; and a right shield plate mounted at a right side of the right end plate. The front cover is detachably mounted to the left shield plate and the right shield plate.

In an embodiment of the present invention, an air inlet grille is provided at the air inlet of the upper cover plate.

In an embodiment of the present invention, the air inlet grille is integrally formed in the upper cover plate.

In an embodiment of the present invention, the front cover is pivotably mounted to the upper base plate.

In an embodiment of the present invention, the front cover defines a covering chamber, the upper base plate and the lower base plate are disposed in the covering chamber and covered by the front cover, and the front cover is provided with an air supply port corresponding to the air outlet in terms of position.

In an embodiment of the present invention, the front cover includes: a front panel configured to cover front surfaces of the upper base plate and the lower base plate; a lower panel having a front edge connected with a lower edge of the front panel, and configured to cover a lower surface of the lower base plate, the air supply port being provided at a position where the front panel and the lower panel are connected; a left panel having a front edge connected with a left edge of the front panel and a lower edge connected with a left edge of the lower panel, rotatably mounted to a left side of the upper base plate and configured to cover the left side thereof; and a right panel having a front edge connected with a right edge of the front panel and a lower edge connected with a right edge of the lower panel, rotatably mounted to a right side of the upper base plate and configured to cover the right side thereof.

In an embodiment of the present invention, the front panel and the lower panel are connected via an arc transition portion.

In an embodiment of the present invention, the fan includes: a fan wheel detachably mounted to the lower base plate; and a motor detachably mounted to the lower base plate and connected with the fan wheel in a transmission way.

In an embodiment of the present invention, a motor mounting groove is provided in the lower base plate; the upper base plate is provided with a water receiving cover; the motor is mounted in the motor mounting groove; the water receiving cover is located below the heat exchanger and presses the motor in the motor mounting groove.

In an embodiment of the present invention, an air deflector is provided at the air outlet of the lower base plate and exposed from the air supply port.

In an embodiment of the present invention, the front cover is pivotably provided to the upper base plate, and further positioned to the lower base plate via a snap assembly.

In an embodiment of the present invention, the snap assembly includes a snap disposed on an inner wall of the front cover and a snapping portion disposed on the lower base plate.

In an embodiment of the present invention, the snap includes an upper snap and a lower snap disposed below the upper snap, and the upper snap and the lower snap each are configured to be fitted with the snapping portion.

In an embodiment of the present invention, the lower base plate includes a front end plate; the snapping portion is formed at an upper edge of the front end plate of the lower base plate; the upper snap is configured to be fitted with a rear wall of the snapping portion; and the lower snap is configured to be fitted with a front wall of the snapping portion.

In an embodiment of the present invention, the upper snap includes an extension part obliquely extending downwards from front to rear, and the extension part is configured to be fitted with the rear wall of the snapping portion.

In an embodiment of the present invention, at least a part of the front end plate protrudes forwards to form the snapping portion, the snapping portion has a left side wall and a right side wall, and the upper snap is limited between the left side wall and the right side wall of the snapping portion.

In an embodiment of the present invention, a distance between the left side wall and the right side wall of the snapping portion is equal to or larger than a size of the upper snap in a left and right direction.

In an embodiment of the present invention, the front cover is further positioned to the lower base plate via a snapping hook assembly, in which the snap structure is located above the air outlet and the snapping hook assembly is located below the air outlet.

In an embodiment of the present invention, the snapping hook assembly includes a snapping hook disposed at an inner wall of the front cover and a first positioning hole disposed in the lower base plate.

In an embodiment of the present invention, the snapping hook extends obliquely and is configured to be fitted in the first positioning hole.

In an embodiment of the present invention, a lower edge of the first positioning hole is provided with a positioning plate obliquely extending forwards and upwards, and the snapping hook is configured to be arranged on the positioning plate.

In an embodiment of the present invention, the front cover is provided with a second positioning block, the upper base plate is provided with a plurality of second positioning holes in different positions and the second positioning block is configured to be fitted with the plurality of with the plurality of second positioning holes in different positions to position the front cover in a state of opening the upper base plate at different opening angles.

In an embodiment of the present invention, the second positioning block is disposed at a side wall of the front cover, and the plurality of second positioning holes are formed in a side wall of the upper base plate.

In an embodiment of the present invention, the plurality of second positioning holes in the same side wall of the upper base plate have respective centers arranged in a circle whose center is located a pivoting axis of the front cover, and each of the plurality of second positioning holes extends along a radial direction of the circle.

In an embodiment of the present invention, a pair of second positioning blocks are provided and disposed at a left side wall and a right side wall of the front cover respectively, a plurality of pairs of second positioning holes are provided, and each pair of second positioning holes are formed in a left side wall and a right side wall of the upper base plate respectively.

In an embodiment of the present invention, the upper base plate is provided with a stopping surface, and the second positioning block is stopped by the stopping surface when the front cover encloses the upper base plate.

In an embodiment of the present invention, the front cover is provided with a stopping block and the upper base plate is provided with a stopping groove, and the stopping block is stopped in the stopping groove when the front cover closes the upper base plate.

In an embodiment of the present invention, a shaft hole is provided in a side wall of the upper base plate, a rotary shaft is provided to a side wall of the front cover, and the rotary shaft is configured to be rotatably fitted in the shaft hole.

In an embodiment of the present invention, the front cover includes a left panel and a right panel, and the left panel is located outside a left end plate of the upper base plate and the right panel is located outside a right end plate of the upper base plate; a second pivoting portion is provided at each of a left end and a right end of the front cover, and a first pivoting portion is provided at each of the left end plate and the right end plate of the upper base plate, in which the first pivoting portion at the left end plate is configured to be fitted with the second pivoting portion at the left end of the front cover while the first pivoting portion at the right end plate is configured to be fitted with the second pivoting portion at the right end of the front cover, such that the front cover is pivotably provided to the upper base plate.

In an embodiment of the present invention, the second pivoting portion at the left end of the front cover is disposed at the left panel, while the second pivoting portion at the right end of the front cover is disposed at the right panel.

In an embodiment of the present invention, the second pivoting portion is located at an upper end of the indoor unit and adjacent to a rear side of the indoor unit.

In an embodiment of the present invention, the first pivoting portion is a configured as pivot hole, while the second pivoting portion is configured as a pivoting shaft.

In an embodiment of the present invention, an elastically deformable snapping member is provided to an outer circumferential wall of the pivoting shaft, a snapping groove is provided in the pivot hole, and the snapping member is configured to be fitted in the snapping groove.

In an embodiment of the present invention, an annular flange is provided on an outer circumferential wall of a free end of the pivoting shaft, and an annular stopping convex rib is provided on a circumferential wall of the pivot hole, and the annular stopping convex rib is configured to be fitted with the annular flange to limit a degree of freedom of the pivoting shaft in a left and right direction.

In an embodiment of the present invention, at least part of an edge of the annular flange is configured as a demoulding plane.

In an embodiment of the present invention, an inner wall of at least one of the left panel and the right panel is provided with a reinforcing rib surrounding the pivot hole and extending inwards, an outer wall of at least one of the left panel and the right panel is provided with a supporting member, and the supporting member is configured to support the pivoting shaft when the pivoting shaft is fitted in the pivot hole.

In an embodiment of the present invention, an elastic relief groove is provided between the reinforcing rib and a body structure of the at least one of the left panel and the right panel.

In an embodiment of the present invention, a guiding groove is provided between the pivot hole and an edge of the at least one of the left panel and the right panel, and the pivoting shaft is configured to slidably enter the pivot hole along the guiding groove.

In an embodiment of the present invention, the guiding groove includes at least two segments of groove extending in directions with an included angle therebetween, and the reinforcing rib extends to the edge of the at least one of the left panel and the right panel.

In an embodiment of the present invention, the left panel or the right panel of the front cover is provided a first limiting member, the left end plate or the right end plate of the upper base plate is provided with a plurality of second limiting members spaced apart from one another, and the first limiting member is configured to be fitted with the plurality of second limiting members to position the front cover at different opening angles.

In an embodiment of the present invention, the first limiting member is configured as a hook, the second limiting member is configured as a limiting step or a limiting hole, and the hook is configured to be fitted with the limiting step or the limiting hole.

In an embodiment of the present invention, the first limiting member is configured as a first positioning block, the second limiting member is configured as a limiting step or a limiting hole, and the first positioning block is configured to be fitted with the limiting step or the limiting hole.

Figure 1:
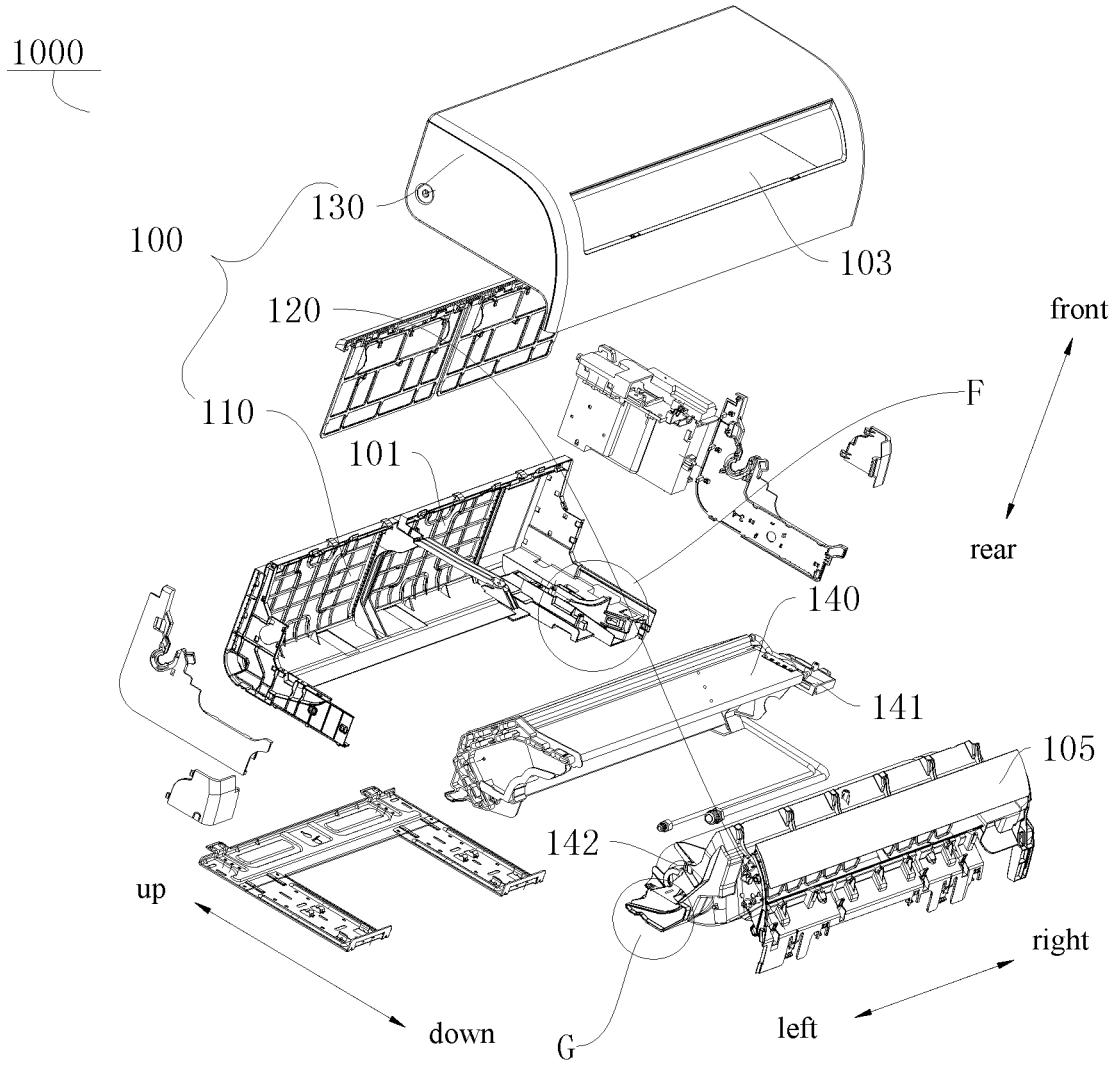
FIG. 1 is an exploded view of an indoor unit of an air conditioner in a direction according to an embodiment of the present invention.

REFERENCE NUMERALS indoor unit 1000 of air conditioner, housing 100, air inlet 101, air supply port 103, covering chamber 104, air deflector 105, upper base plate 110, rear baffle 111, upper cover plate 112, left end plate 113, right end plate 114, left shield plate 115, right shield plate 116, air inlet grille 117, lower base plate 120, front end plate 127, snapping portion 128, left side wall 1281, right side wall 1282;

positioning hole 127*a*, positioning plate 127*b*, front cover 130, front panel 131, lower panel 132, left panel 133, right panel 134, heat exchanger 140, water receiving cover 141, fan 142, fan wheel 143, motor 144, filter mesh 145, first pivoting portion 710, pivot hole 711, snapping groove 712, guiding groove 714, second limiting member 715, limiting step 7151, limiting gap 7152, limiting hole 7153, second pivoting portion 720, pivoting shaft 721, sleeve 7210, snapping member 7211, annular flange 7212, demoulding plane 7213, protrusion 7214, first limiting member 730, first positioning block 731, direction M of opening the front cover, snap 136, upper snap 1361, lower snap 1362, snapping hook 1363, first pivoting structure 137, positioning hole 751, stopping surface 752, stopping groove 753, second positioning block 754, stopping block 755.

DETAILED DESCRIPTION

Embodiments of the present invention will be described in detail and examples of the embodiments will be illustrated in the drawings, where same or similar reference numerals are used to indicate same or similar members or members with same or similar functions. The embodiments described herein with reference to drawings are explanatory, which are used to illustrate the present invention, but shall not be construed to limit the present invention.

As shown in FIGS. 1 to 5, an indoor unit 1000 of an air conditioner according to an embodiment of the present invention includes a housing 100, a heat exchanger 140 and a fan 142.

Specifically, the housing 100 includes an upper base plate 110, a lower base plate 120 detachably mounted to the upper base plate 110, and a front cover 130 detachably mounted to the upper base plate 110. The upper base plate 110 is provided with an air inlet 101 for imputing air, and the lower base plate 120 is provided with an air outlet (not shown) for outputting air. Driven by the fan 142, an air flow enters the indoor unit 1000 from the air inlet 101 and is sent out through the air outlet. The air flow exchanges heat with the heat exchanger 140 in the indoor unit 1000. The heat exchanger 140 is mounted to the upper base plate 110 and the fan 142 is detachably mounted to the lower base plate 120.

For the indoor unit 1000 according to the embodiment of the present invention, the fan 142 is mounted to the lower base plate 120 and the lower base plate 120 is detachably mounted to the upper base plate 110, such that the cleaning, maintenance and repair of the fan 142 just need to dismount the lower base plate 120 from the upper base plate 110, and hence the fan 142 can be dismounted from the indoor unit 1000, which avoids the problem in the prior art that the heat exchanger 140 affects the mounting and dismounting of the fan 142. The convenient dismounting of the fan 142 in the present invention facilitates cleaning a fan wheel 143 of the fan 142. The cleaning of the fan wheel 143 does not involve the dismounting and mounting of the heat exchanger 140, which avoids the problem that the heat exchanger 140 tends to break down due to the dismounting and mounting thereof, thus facilitating the maintenance of the indoor unit 1000 and reducing the failure rate of the indoor unit 1000.

Figure 2:
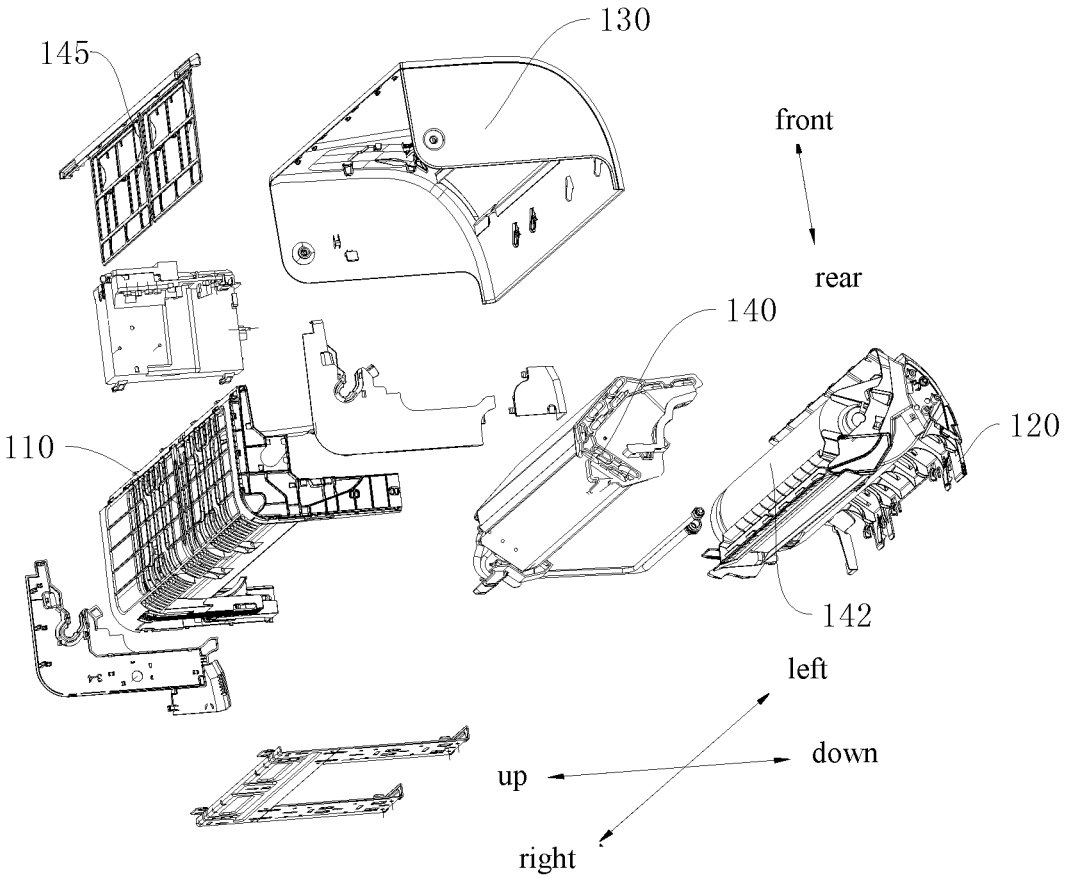
FIG. 2 is an exploded view of an indoor unit of an air conditioner in another direction according to an embodiment of the present invention.
Figure 3:
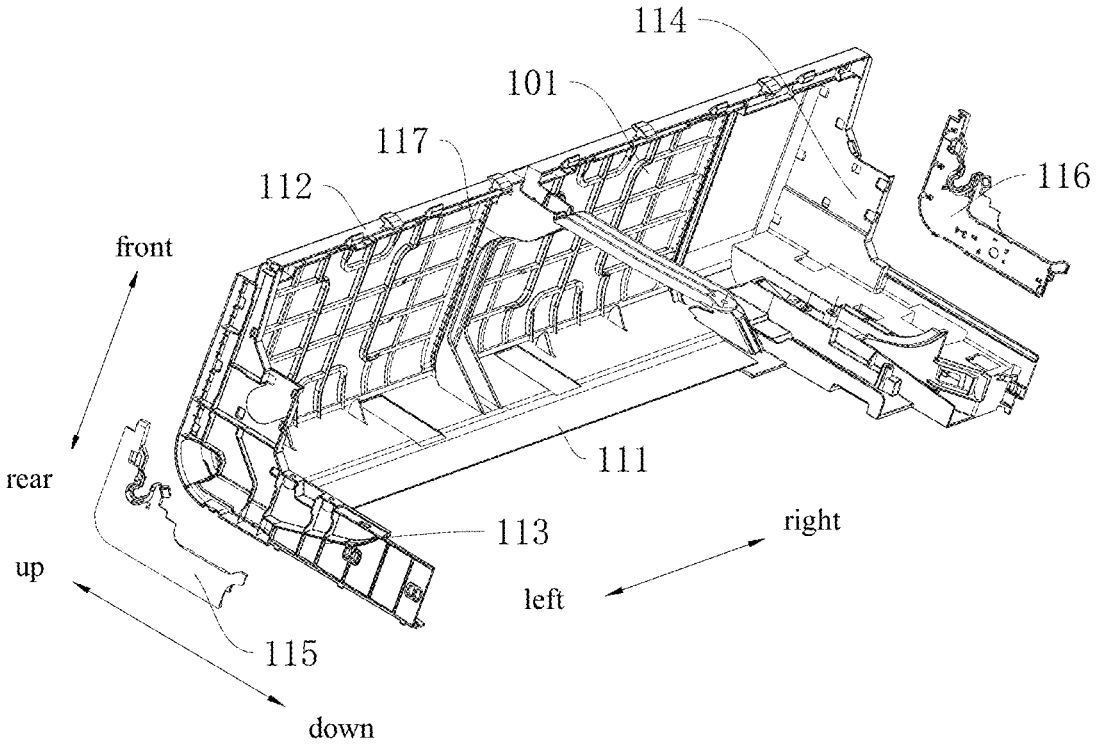
FIG. 3 is a schematic view of an upper base plate of an indoor unit according to an embodiment of the present invention.

With reference to FIGS. 1 to 3, in some embodiments of the present invention, the upper base plate 110 includes: a rear baffle 111, an upper cover plate 112, a left end plate 113 and a right end plate 114. The heat exchanger 140 is mounted to the rear baffle 111. A rear edge of the upper cover plate 112 is connected with an upper edge of the rear baffle 111, and the air inlet 101 is formed in the upper cover plate 112, such that the air flow may enter the indoor unit 1000 from the air inlet 101 to exchange heat. The left end plate 113 has a rear edge connected with a left edge of the rear baffle 111 and an upper edge connected with a left edge of the upper cover plate 112. The right end plate 114 has a rear edge connected with a right edge of the rear baffle 111 and an upper edge connected with a right edge of the upper cover plate 112. Thus, the structural strength of the upper base plate 110 is improved and it is convenient to mount the heat exchanger 140 to the upper base plate 110, thereby improving the structural strength of the whole indoor unit 1000.

Additionally, by providing the air inlet 101 in the upper cover plate 112 of the upper base plate 110 and mounting the heat exchanger 140 to the rear baffle 111, a gap may be formed between the heat exchanger 140 and the upper cover plate 112 provided with the air inlet 101, such that the air flow may enter the indoor unit 1000 smoothly, to guarantee the smooth circulation of the air flow and improve the working efficiency of the indoor unit 1000.

Preferably, the lower base plate 120 is detachably mounted to a right side of the left end plate 113 and to a left side of the right end plate 114. The left end plate 113 is located at a left side of the lower base plate 120, and the right end plate 114 is located at a right side of the lower base plate 120, to facilitate mounting the lower base plate 120 to the upper base plate 110 and disassembling the lower base plate 120 therefrom.

Further, with reference to FIGS. 1 to 3, the upper base plate 110 further includes a left shield plate 115 and a right shield plate 116. The left shield plate 115 is mounted to the left side of the left end plate 113, and the right shield plate 116 is mounted to the right side of the right end plate 114, so as to further improve the structural strength of the upper base plate 110 via the left shield plate 115 and the right shield plate 116 and also to enhance the sealing performance of the left and right sides of the upper base plate 110, along with ensuring a beautiful appearance of the housing 100.

Preferably, the front cover 130 is detachably mounted over the left shield plate 115 and the right shield plate 116, which facilitates mounting the front cover 130 and improves the assembling and maintenance efficiency of the indoor unit 1000.

Advantageously, as shown in FIG. 3, an air inlet grille 117 is provided at the air inlet 101 of the upper cover plate 112, which makes it convenient for the air flow to enter the indoor unit 1000 via the air inlet 101, and prevents dust from the outside from entering the indoor unit 1000 to a certain extent, thus reducing the amount of dust entering the indoor unit 1000, so as to facilitate cleaning the indoor unit 1000 and to improve the stability and safety of the operation thereof.

Advantageously, the air inlet grille 117 is integrally formed in the upper cover plate 112, so as to improve the structural strength of the air inlet grille 117 and facilitate the molding of the upper cover plate 112.

Additionally, the upper base plate 110 according to the present invention may be configured as other forms of structures. For example, the upper base plate 110 may only include the upper cover plate 112, but not the rear baffle 111, as long as the upper cover plate 112 is formed with positions where the heat exchanger 140 and the lower base plate 120 are mounted.

In some embodiments of the present invention, the front cover 130 is pivotably mounted over the upper base plate 110. That is, the front cover 130 is mounted over the upper base plate 110 and rotatable between a first position where the housing 100, the heat exchanger 140 and the fan 142 are covered and a second position where the housing 100, the heat exchanger 140 and the fan 142 are exposed, so as to facilitate mounting the heat exchanger 140 and the fan 142 to the housing 100 and dismounting the heat exchanger 140 and the fan 142 therefrom.

Figure 4:
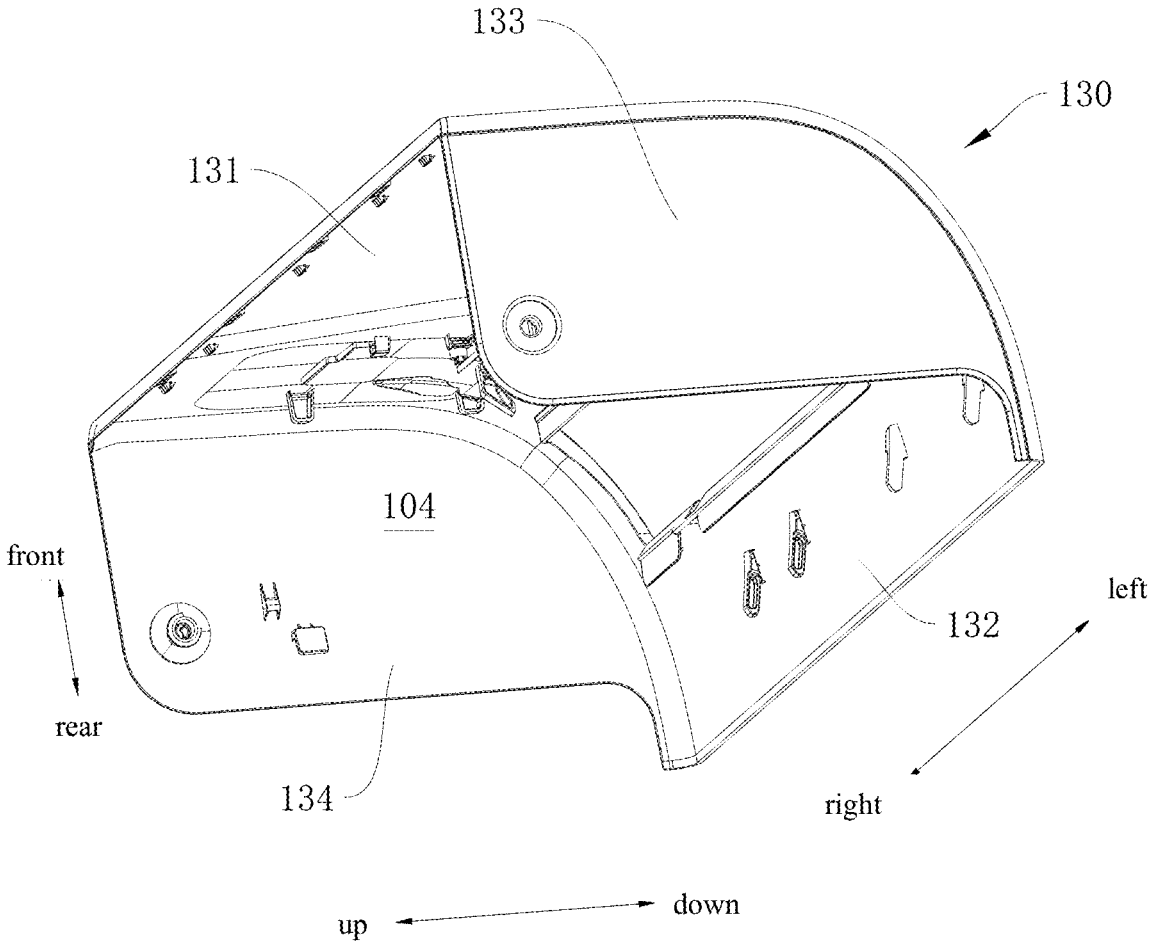
FIG. 4 is a schematic view of a front cover of an indoor unit according to an embodiment of the present invention.

Referring to FIGS. 1, 2 and 4, in some embodiments of the present invention, the front cover 130 defines a covering chamber 104, and the upper base plate 110 and the lower base plate 120 are disposed in the covering chamber 104 and covered by the front cover 130, such that the indoor unit 1000 has a beautiful appearance and is closed, thus facilitating an oriented air supply. Alternatively, an air supply port 103 corresponding to the air outlet in terms of position is provided in the front cover 130 and configured to avoid the air outlet. That is, a position of the air supply port 103 is corresponding to a position of the air outlet.

Further, with reference to FIGS. 1, 2 and 4, the front cover 130 includes a front panel 131, a lower panel 132, a left panel 133 and a right panel 134. The front panel 131 covers front surfaces of the upper base plate 110 and the lower base plate 120. The lower panel 132 has a front edge connected with a lower edge of the front panel 131, and covers a lower surface of the lower base plate 120, in which the air supply port 103 is provided at a position where the front panel 131 and the lower panel 132 are connected. The left panel 133 has a front edge connected with a left edge of the front panel 131 and a lower edge connected with a left edge of the lower panel 132, and is rotatably mounted to a left side of the upper base plate 110 and covers the left side thereof. The right panel 134 has a front edge connected with a right edge of the front panel 131 and a lower edge connected with a right edge of the lower panel 132, and is rotatably mounted to a right side of the upper base plate 110 and covers the right side thereof. Consequently, the front cover has a simple structure and a high strength, is convenient to process at a low production cost, and can protect components inside the indoor unit fully.

Further, with reference to FIG. 1, the left panel 133 is provided at the left side of the upper base plate 110, and the right panel 134 is provided at the right side thereof. A rotary shaft is provided at a rear end of an upper portion of each of the left panel 133 and the right panel 134, while a shaft hole fitted with the rotary shaft is provided in each of the left shield panel 115 and the right shield panel 116 of the upper base plate 110, so as to realize the rotatable mounting of the front cover 130 to the housing 100 via the fitting of the shaft and the hole.

Advantageously, the front panel 131 and the lower panel 132 are connected via an arc transition portion, to make the appearance of the indoor unit 100 aesthetic. Moreover, a rounded-off surface (i.e., a surface of the arc transition portion) is less easy to be damaged than an angular surface during the transportation of the indoor unit 1000.

Additionally, the front panel 131 and the lower panel 132 of the front cover 130 may be molded separately, in which the lower panel 132 may be integrally formed with the lower panel 120.

Figure 5:
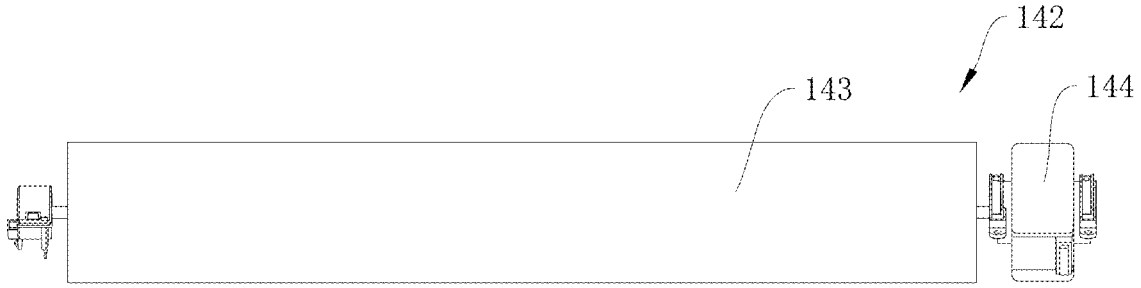
FIG. 5 is a schematic view of a fan of an indoor unit according to an embodiment of the present invention.
Figure 6:
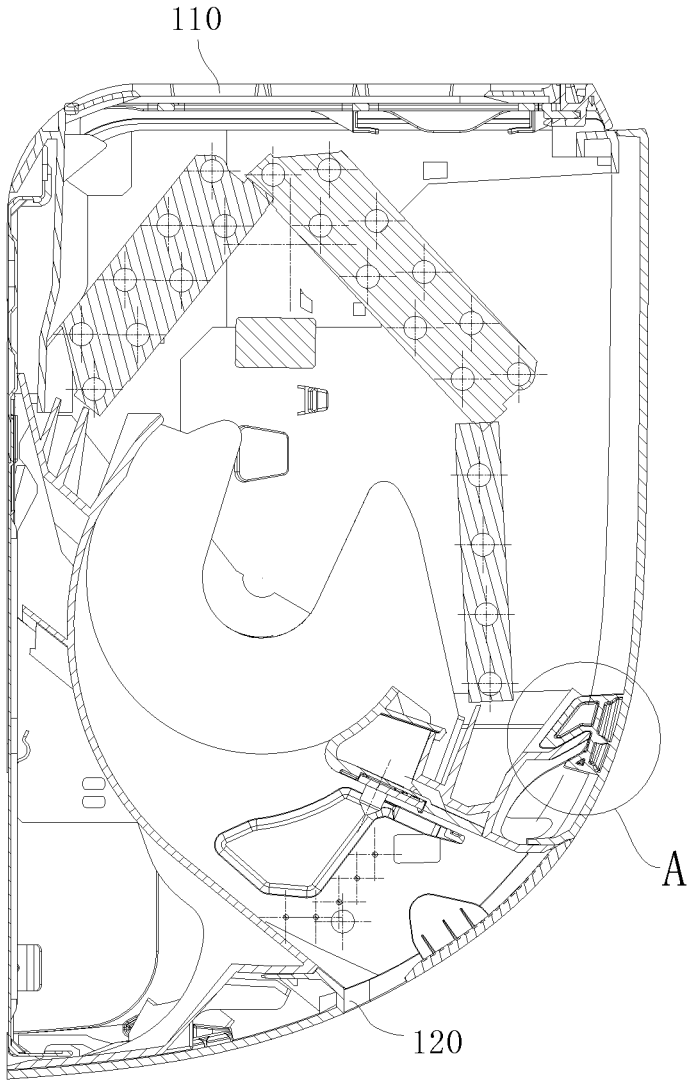
FIG. 6 is a sectional view of an indoor unit of an air conditioner according to an embodiment of the present invention.

As shown in FIG. 5, in some embodiments of the present invention, the fan 142 includes a fan wheel 143 and a motor 144. The fan wheel 143 is detachably mounted to the lower base plate 120, and the motor 144 is detachably mounted to the lower base plate 120 and connected with the fan wheel 143 in a transmission manner, so as to facilitate the operation, mounting and dismounting of the fan 142.

Further, the lower base plate 120 is provided with a motor mounting groove (not shown), the upper base plate 110 is provided with a water receiving cover 141, the motor 144 is mounted in the motor mounting groove, and the water receiving cover 141 is located below the heat exchanger 140 and presses the motor 144 in the motor mounting groove.

In some embodiments of the present invention, an air deflector 105 is provided at the air outlet of the lower base plate 120 and exposed from the air supply port 103, to guide the direction of the air flow sent out from the indoor unit 1000.

In an embodiment of the present invention, the housing 100 of the indoor unit 1000 includes the lower base plate 120, the upper base plate 110 and the front cover 130. The lower base plate 120 is provided with the air outlet and a fan mounting structure (not shown) for mounting the fan 142. The upper base plate 110 is detachably mounted to the lower base plate 120, and provided with the air inlet 101 and a heat-exchanger mounting structure for mounting the heat exchanger 140. The front cover 130 is detachably mounted to the upper base plate 110 and provided with the air supply port 103 in a position corresponding to that of the air outlet.

In the housing 100 of the indoor unit 1000 according to this embodiment of the present invention, the fan 142 and the heat exchanger 140 may be mounted, dismounted and cleaned conveniently by mounting the fan 142 to the lower base plate 120 via the fan mounting structure and mounting the heat exchanger 140 to the upper base plate 110 via the heat-exchanger mounting structure.

In the present invention, the upper base plate 110 is provided to mount the heat exchanger 140 thereto, and the lower base plate 120 is provided to mount the fan 142 thereto. The lower base plate 120 and the fan 142 are mounted below the upper base plate 110 and the heat exchanger 140, such that the dismounting of the fan 142 only needs to dismount the lower base plate 120 located below from the upper base plate 110, and thus the fan 142 can be detached from a main body of the indoor unit 1000, which facilitates the maintenance and cleaning of the fan 142. The procedure of cleaning the fan 142 of the indoor unit 1000 is simplified, and even the user may clean the fan by himself/herself.

In addition, the front cover 130 is configured to be pivotably connected with the upper base plate 110. The process of dismounting and mounting the fan 142 does not need to dismount the front cover 130 (or the front cover 130 may be dismounted very easily), which further facilitates the maintenance of the fan 142 of the indoor unit 1000.

As shown in FIGS. 1 to 15, in an embodiment of the present invention, the indoor unit may include: a base plate, the heat exchanger 140, the fan wheel 143 and the front cover 130. Specifically, referring to FIGS. 1 and 2, the base plate may include the upper base plate 110 and the lower base plate 120, and the lower base plate 120 is detachably mounted to the upper base plate 110 and provided with the air outlet. The heat exchanger 140 is disposed to the upper base plate 110, and the fan wheel 143 is disposed to the lower base plate 120. The front cover 130 is pivotably disposed to the upper base plate 110 and positioned to the lower base plate 120 via a snap assembly, and also, the front cover 130 is further provided with the air supply port 103 corresponding to the air outlet.

In examples shown in FIGS. 1 and 2, the lower base plate 120 is mounted at a lower side of the upper base plate 110, and the air outlet is provided at a front side of the lower base plate 120. The heat exchanger 140 is mounted to the upper base plate 110, and the fan wheel 143 is mounted to the lower base plate 120, such that the fan wheel 143 is located below the heat exchanger 140. The front cover 130 is provided over the upper base plate 110 and the lower base plate 120. The fan wheel 143 is preferably opposite to the air outlet, and the air supply port in the front cover 130 is also opposite to the air outlet. Consequently, the air flowing into the indoor unit may exchange heat with the heat exchanger 140 in advance, and then, driven by the fan wheel 143, be exhausted from the air outlet and the air supply port, so as to regulate an indoor temperature.

An upper portion of the front cover 130 is pivotably connected with the upper base plate 110 while a lower portion of the front cover 130 is connected with the lower base plate 120 via the snap assembly. In such a way, in the process of assembling the front cover 130, first a pivotable connection structure between the front cover 130 and the upper base plate 110 may be assembled in place, and then the front cover 130 is rotated to make a snapping connection structure between the front cover 130 and the lower base plate 120 assembled in place, so that the front cover 130 may be fixed to the upper base plate 110 and the lower base plate 120 firmly. Similarly, the process of disassembling the front cover 130 only needs to disassemble the snapping connection structure between the front cover 130 and the lower base plate 120 and then to pivotably open the front cover 130.

Consequently, the front cover 130 is mounted reliably and dismounted conveniently. The front cover 130 may be opened conveniently and quickly when the heat exchanger 140, the fan wheel 143 or the motor 144 inside the indoor unit needs to be repaired or cleaned, and then the cleaning, maintenance and repair can be implemented successfully. After the cleaning, maintenance and repair, the front cover 130 may be closed conveniently and quickly, and further fixed firmly again, thus considerably facilitating the cleaning, maintenance and repair of the indoor unit.

In the indoor unit 1000 according to the embodiment of the present invention, by connecting the integral front cover 130 with the upper base plate 110 in a pivotable manner, and with the lower base plate 120 via the snap assembly, the efficiency of mounting and dismounting the front cover 130 is improved effectively, thus facilitating the cleaning, maintenance and repair of the indoor unit. Moreover, the integral front cover 130 has a simple structure and an aesthetic appearance, and is convenient to manufacture at a low production cost.

In an embodiment of the present invention, a first pivoting structure may be provided at each of a left side and a right side of the front cover 130, and a second pivoting structure may be provided at each of the left side and the right side of the upper base plate 110. The first pivoting structure may constitute a pivotable fitting with the second pivoting structure, so as to realize the pivotable connection of the front cover 130 and the upper base plate 110. The first pivoting structure may be a pivoting cover plate with a pivoting shaft, and the second pivoting structure may be a pivot hole. Certainly, the present invention is not limited thereby, and the pivotable connection of the front cover 130 and the upper base plate 110 may be implemented in other manners.

In an embodiment of the present invention, as shown in FIGS. 6 to 12, the snap assembly includes a snap 136 disposed on an inner wall of the front cover 130 and a snapping portion 128 disposed on the lower base plate 120. The snap 136 is disposed on a side wall of the front cover 130 adjacent to the lower base plate 120, and the snapping portion 128 is disposed on a side wall of the lower base plate 120 adjacent to the front cover 130. When the front cover 130 pivots to a position where the snap 136 and the snapping portion 128 may be naturally fitted with each other in place, the snapping connection between the front cover 130 and the lower base plate 120 is implemented. Therefore, the snap assembly is divided into two parts disposed on the front cover 130 and the lower base plate 120 respectively, so as to make the structure of the indoor unit simple and the assembling thereof convenient. Certainly, the snap 136 may be disposed on the lower base plate 120, and the snapping portion 128 is disposed on the front cover 130.

Specifically, as shown in FIGS. 6 to 12, the snap 136 includes an upper snap 1361 and a lower snap 1362 disposed below the upper snap 1361, and the upper snap 1361 and the lower snap 1361 each are fitted with the snapping portion 128. Thus, since the snapping portion 128 is fitted with the upper snap 1361 and the lower snap 1362 at the same time, the snapping portion 128 is fitted with the snap 136 in an up and down direction, so as to improve the fitting reliability of the snap 136 and the snapping portion 128.

Figure 13:
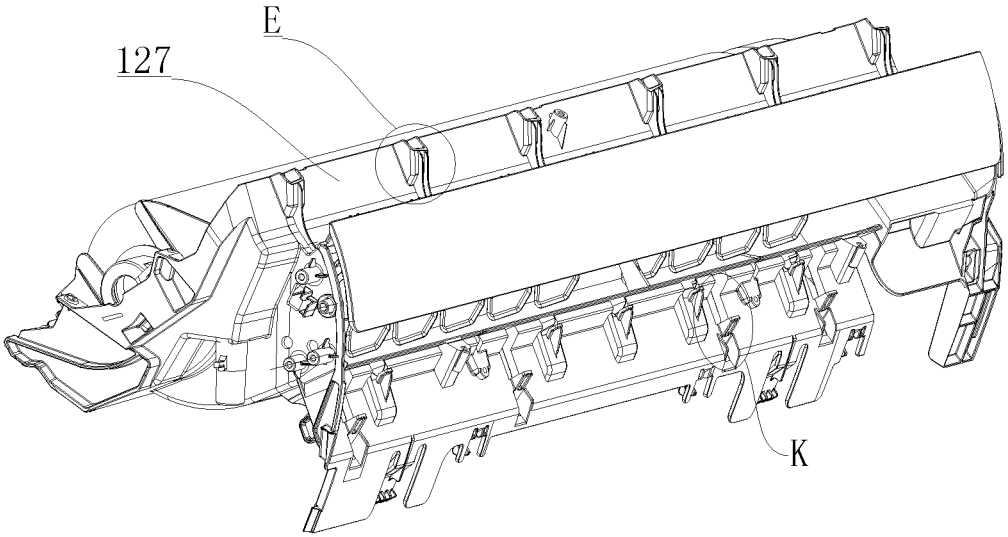
FIG. 13 is an assembly view of a lower base plate and a fan wheel of an indoor unit of an air conditioner according to an embodiment of the present invention.
Figure 14:
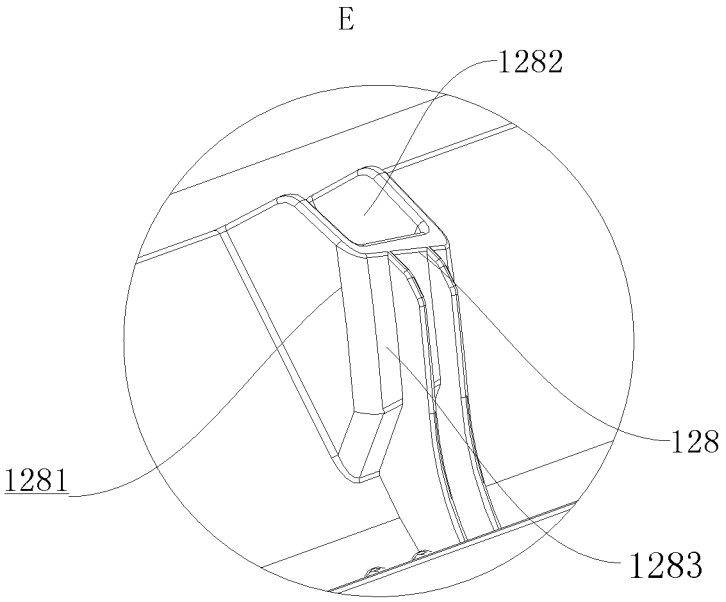
FIG. 14 is an enlarged view of part E in FIG. 13.
Figure 15:
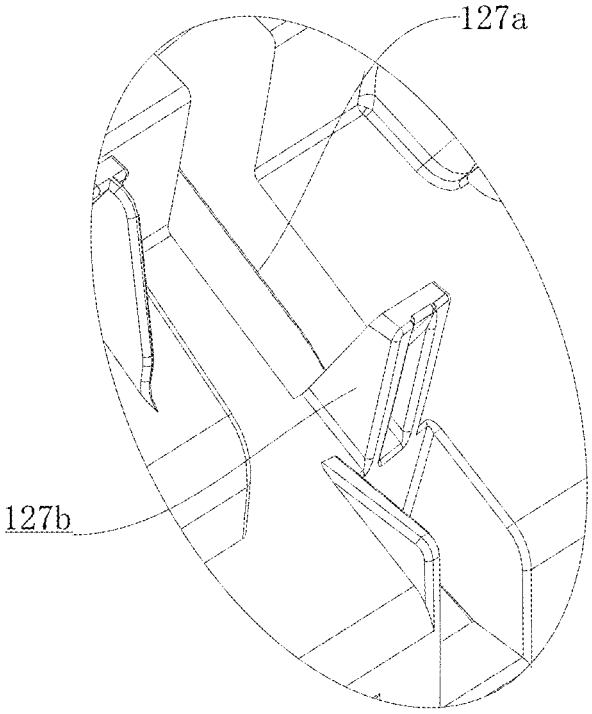
FIG. 15 is an enlarged view of part K in FIG. 13.

Specifically, as shown in FIGS. 13 to 15, the lower base plate 120 includes a front end plate 127, and the snapping portion 128 is formed at an upper edge of the front end plate 127 of the lower base plate 120. The upper snap 1361 is fitted with a rear wall of the snapping portion 128, and the lower snap 1362 is fitted with a front wall of the snapping portion 128. Thus, the snapping portion 128 is clamped between the upper snap 1361 and the lower snap 1362 in the up and down direction, and the snapping portion 128 is also clamped between the upper snap 1361 and the lower snap 1362 in a front and rear direction, such that the snapping portion 128 is limited firmly by the snap 136 in the up and down direction and also in the front and rear direction, thus improving the fitting reliability of the snap assembly. Hence, the front cover 130 may be fixed to the lower base plate 120 firmly to prevent relative displacements between the front cover 130 and the lower base plate 120 in the up and down direction and/or in the front and rear direction.

In a specific example of the present invention, as shown in FIGS. 6 to 15, the upper snap 1361 includes an extension part obliquely extending downwards from front to rear, and the extension part is fitted with the rear wall of the snapping portion 128. Consequently, a rear end face of the extension part may abut against the rear wall of the snapping portion 128, to effectively prevent the snap 136 of the front cover 130 from moving rearwards relative to the snapping portion 128 of the lower base plate 120, i.e. to prevent a rearward movement of the front cover 130 relative to the lower base plate 120, thus further improving the reliability of connecting the front cover 130 with the lower base plate 120.

Figure 7:
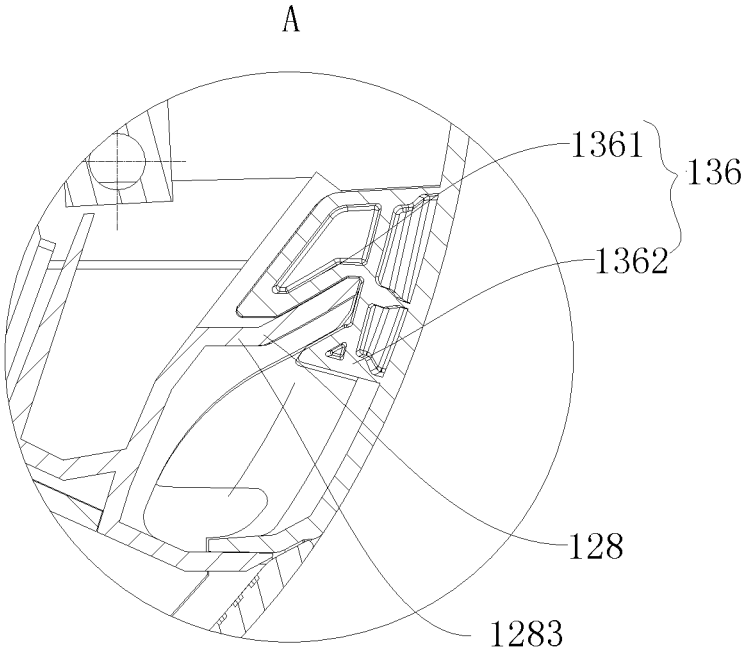
FIG. 7 is an enlarged view of part A in FIG. 6.
Figure 8:
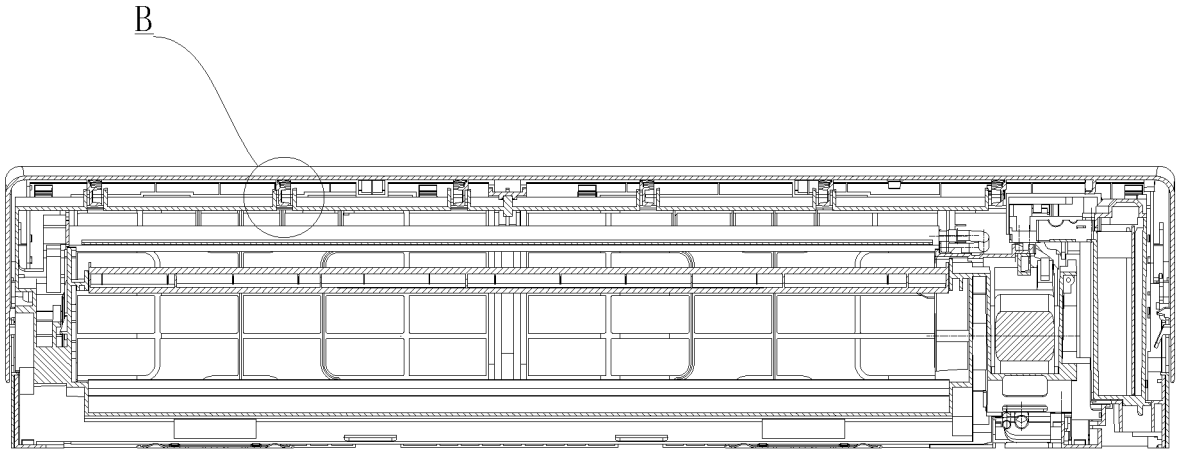
FIG. 8 is a sectional view of an indoor unit of an air conditioner according to an embodiment of the present invention.
Figure 9:
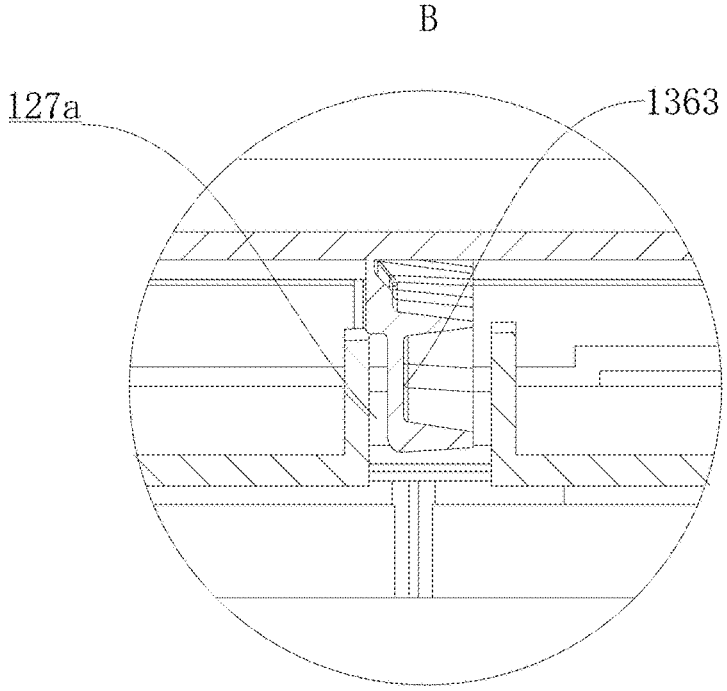
FIG. 9 is an enlarged view of part B in FIG. 8.
Figure 10:
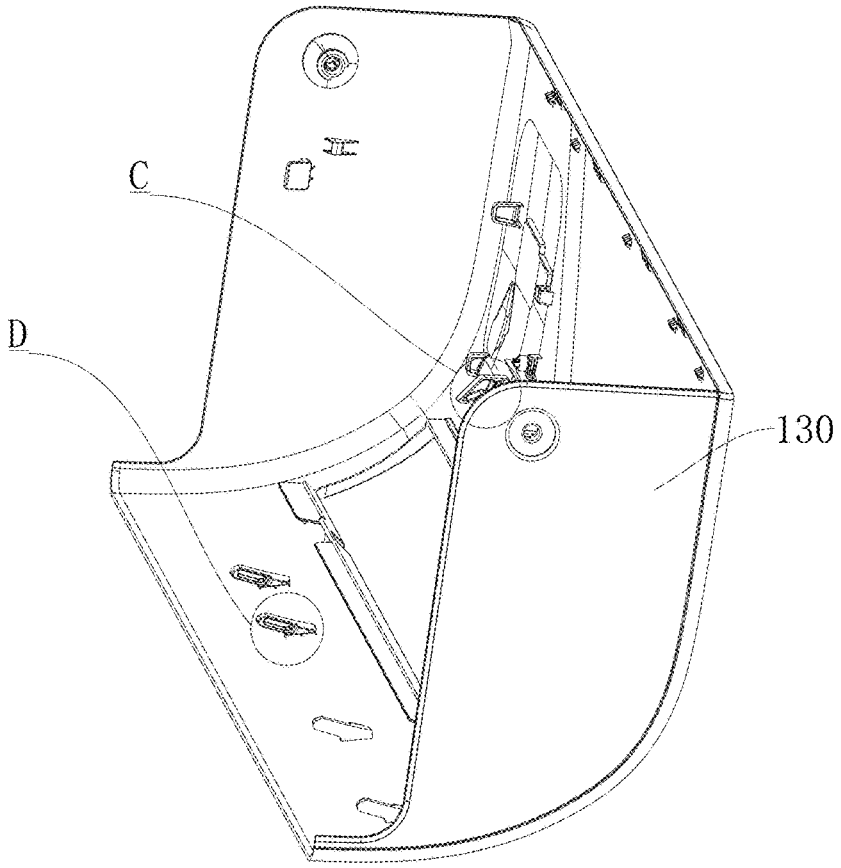
FIG. 10 is a perspective view of a front cover of an indoor unit according to an embodiment of the present invention.
Figure 11:
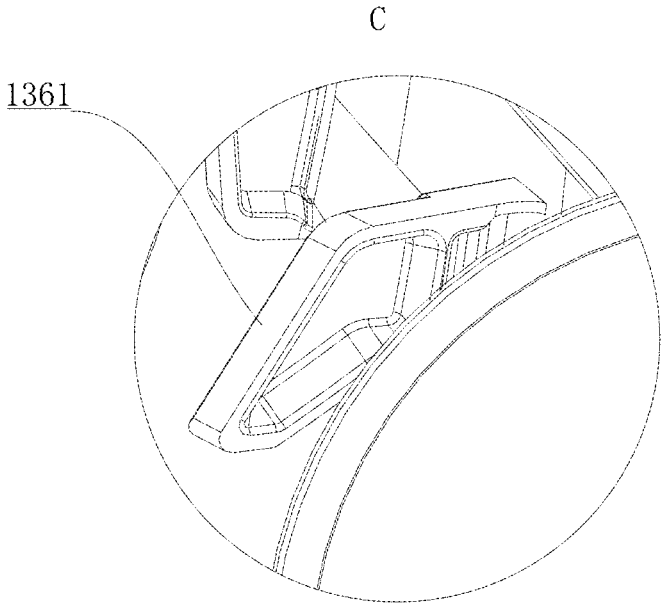
FIG. 11 is an enlarged view of part C in FIG. 10.
Figure 12:
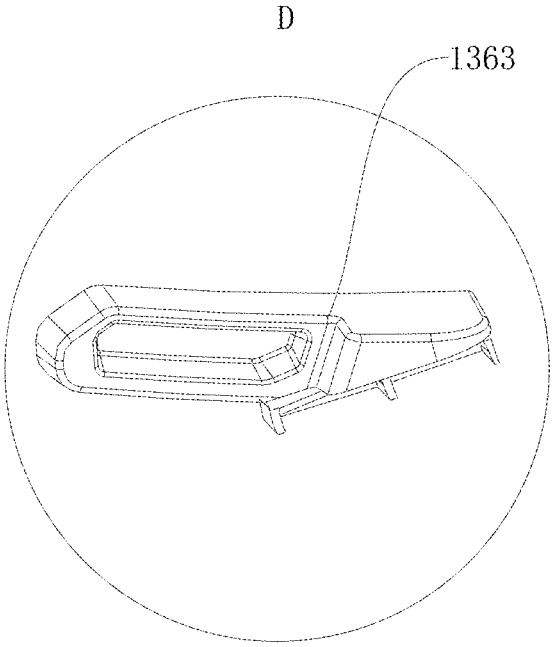
FIG. 12 is an enlarged view of part D in FIG. 10.

Alternatively, as shown in FIGS. 6 to 15, at least a part of the front end plate 127 protrudes forwards to form the snapping portion 128. That is, the snapping portion 128 and the front end plate 127 are molded integrally. The snapping portion 128 has a base portion 1283 protruding from the front end plate 127 of the lower base plate 120 and configured to be clamped between the upper snap 1361 and the lower snap 1362, as shown in FIG. 7. Further, as shown in FIG. 14, the snapping portion 128 also has a left side wall 1281 and a right side wall 1282 spaced apart from each other in a left and right direction. Thus, the fitting reliability of the snap assembly is improved to make the front cover 130 firmly fixed to the lower base plate 120 and further to prevent the relative displacements between the front cover 130 and the lower base plate 120 in the left and right direction.

Referring to FIGS. 6 to 15, a distance between the left side wall 1281 and the right side wall 1282 of the snapping portion 128 is equal to or larger than a size of the upper snap 1361 in the left and right direction. That is, a width between the left side wall 1281 and the right side wall 1282 is equal to or larger than a width of the upper snap 1361 in the left and right direction. Thus, it is convenient for the upper snap 1361 to be inserted into and fitted between the left side wall 1281 and the right side wall 1282, thus improving the assembling efficiency.

Further, the front cover 130 is further positioned to the lower base plate 120 via a snapping hook assembly, in which the snap assembly is located above the air outlet while the snapping hook assembly is located below the air outlet, such that the front cover 130 may be fitted with the lower base plate 120 via the snap assembly above the air outlet, and the front cover 130 may be fitted with the lower base plate 120 via the snapping hook assembly below the air outlet. In such a way, portions of the lower base plate 120 located above and below the air outlet both are fitted with the front cover 130, to further improve the reliability and completeness of connecting the front cover 130 with the lower base plate 120 and to prevent the front cover 130 from being opened unexpectedly or be left with a gap, thereby ensuring the aesthetics and reliability of the whole indoor unit.

Referring to FIGS. 6 to 15, the snapping hook assembly includes a snapping hook 1363 disposed on the inner wall of the front cover 130 and a first positioning hole 127*a* formed in the lower base plate 120. A plurality of snapping hooks 1363 may be provided and spaced apart from one another in the left and right direction. Correspondingly, a plurality of first positioning holes 127*a* are provided and spaced apart from one another in the left and right direction. Thus, in the process of assembling the front cover 130 with the lower base plate 120, it is possible for each snapping hook 1363 to be fitted in the corresponding first positioning hole 127*a*, so as to achieve an effective positioning effect by the fitting of the snapping hook 1363 and the first positioning hole 127*a*. This kind of snapping hook assembly has a simple structure and a low production cost, and provides a reliable position limiting function.

Alternatively, the snapping hook 1363 extends obliquely and is fitted in the first positioning hole 127*a*. For instance, in an example of the present invention, a lower end of the snapping hook 1363 may abut against a bottom wall of the first positioning hole 127*a*, such that the first positioning hole 127*a* may serve to support the snapping hook 1363 and prevent the front cover 130 from moving downwards, thereby ensuring that the air supply port directly faces the air outlet without any bias, which bias may result in a poor air exhaust effect.

Further, a positioning plate 127*b* is provided at a lower edge of the first positioning hole 127*a* and obliquely extends forwards and upwards, and the snapping hook 1363 is disposed on the positioning plate 127*b*. Thus, the connection of the snapping hook 1363 and the positioning plate 127*b* may prevent the snapping hook 1363 from slipping off the first positioning hole 127*a* and further improve the reliability of connecting the front cover 130 with the lower base plate 120.

Preferably, as shown in FIGS. 1 and 2, the front panel 131 and the lower panel 132 are connected with each other by the arc transition portion, to further improve the structural strength of the front cover 130 and also the aesthetics of the front cover 130. The snap 136 may be provided on an inner side wall of the arc transition portion, and the snapping hook 1363 may be provided on the lower panel 132, such that the snap 136 is located above the snapping hook 1363 to ensure that each of the front panel 131 and the lower panel 132 may be fitted with and positioned to the lower base plate 120 with the firm connection therebetween.

The upper base plate 110 is provided with the air inlet grille 117. In an example shown in FIG. 1, the air inlet grille 117 may be provided at a top of the upper base plate 110, and define the air inlet 101, such that the indoor air may enter the indoor unit via the air inlet grille 117 to exchange heat, and then be sent out by the fan wheel 143. Certainly, the present invention is not limited thereby, and the air inlet 101 may be formed in other positions.

Referring to FIGS. 16 to 19, in an embodiment of the present invention, the housing of the indoor unit may include the base plate and the front cover 130. The front cover 130 is pivotably mounted to the base plate to open or close the base plate. The base plate is provided with a plurality of second positioning holes 751, and the front cover 130 is provided with a second positioning block 754. The second positioning block 754 is configured to be fitted with second positioning holes 751 in different positions to position the front cover 130 in an open state at different opening angles.

In other words, the housing includes the base plate and the front cover 130 pivotably mounted to the base plate. The front cover 130 opens or closes the base plate through a pivoting movement thereof, i.e. exposing or shielding the base plate through the pivoting movement thereof. In this structure, the front cover 130 is directly mounted to the base plate without any frame, or the front cover 130 in one piece replaces separate panel and frame in the related art, which facilitates assembling. Moreover, the fan wheel 143 or other components may be detached by only dismounting the integral front cover 130, such that a decreased number of components need to be detached, thus facilitating mounting and dismounting.

The base plate is provided with the plurality of second positioning holes 751 in different positions, and the front cover 130 is provided with the second positioning block 754. When the second positioning block 754 is fitted with a certain second positioning hole 751, the front cover 130 may be positioned. As the front cover 130 pivots, the second positioning block 754 may be switched among the plurality of second positioning holes 751. That is, the front cover 130 may be positioned and fixed in different positions during the pivoting movement thereof, to realize its fixing at multiple pivoting angles. That is, the fitting of the second positioning block 754 with the plurality of second positioning holes 751 makes it possible for the front cover 130 in the open state to be positioned and fixed at the multiple pivoting angles.

Consequently, by providing the base plate with the plurality of second positioning holes 751 and providing the front cover 130 with the second positioning block 754 configured to be fitted with the plurality of second positioning holes 751, it is possible for the front cover 130 in a state of opening the base plate to be positioned and fixed at multiple pivoting angles. The increased positioning angles may realize a function of mounting or dismounting a filter mesh 145 and a function of quick piping and wiring, and facilitate the mounting, dismounting and repair. Also, the design of the integral front cover 130 further simplifies the assembling and reduces the production cost, along with the simple manufacturing process and the high production efficiency.

Figure 16:
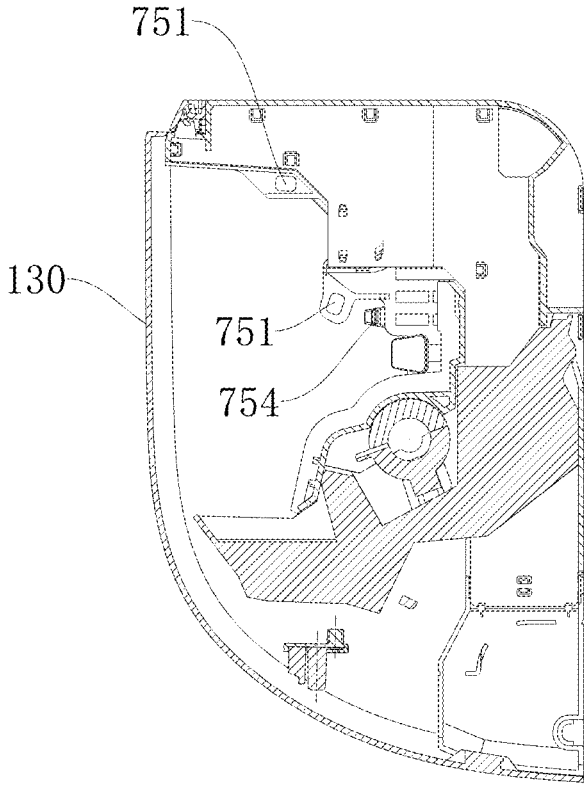
FIG. 16 is a sectional view of an indoor unit of an air conditioner according to an embodiment of the present invention, in which a front cover is in a closed state.
Figure 17:
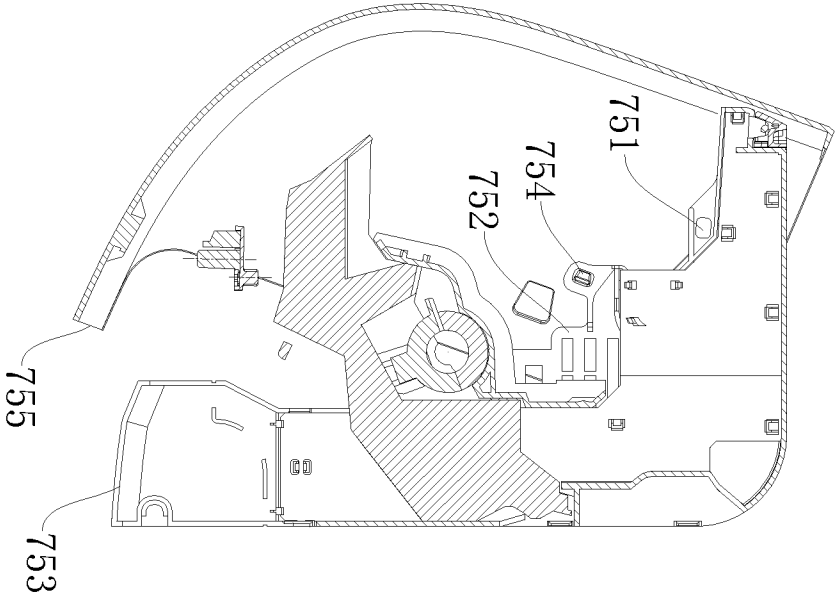
FIG. 17 is a sectional view of an indoor unit of an air conditioner according to an embodiment of the present invention, in which a front cover is in an open position.
Figure 18:
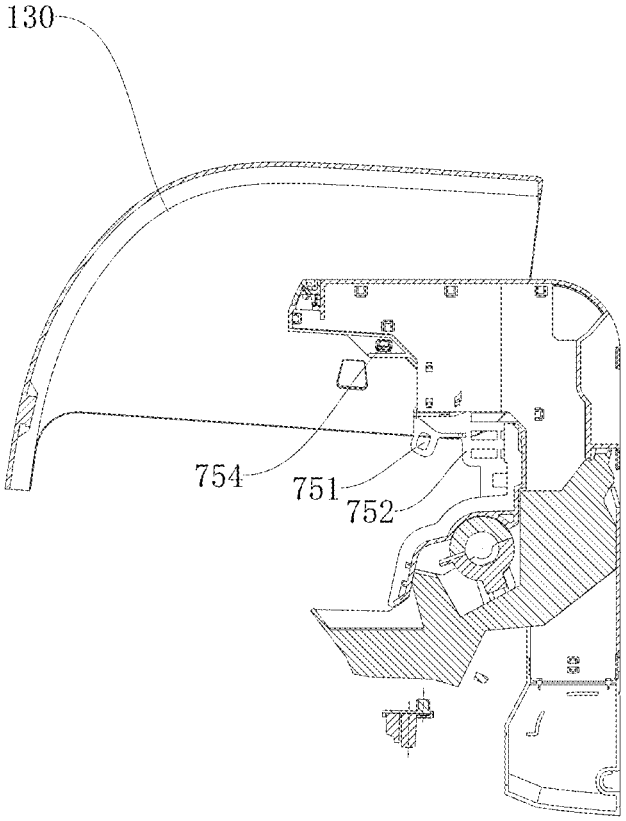
FIG. 18 is a sectional view of an indoor unit of an air conditioner according to an embodiment of the present invention, in which a front cover is in another open position.
Figure 19:
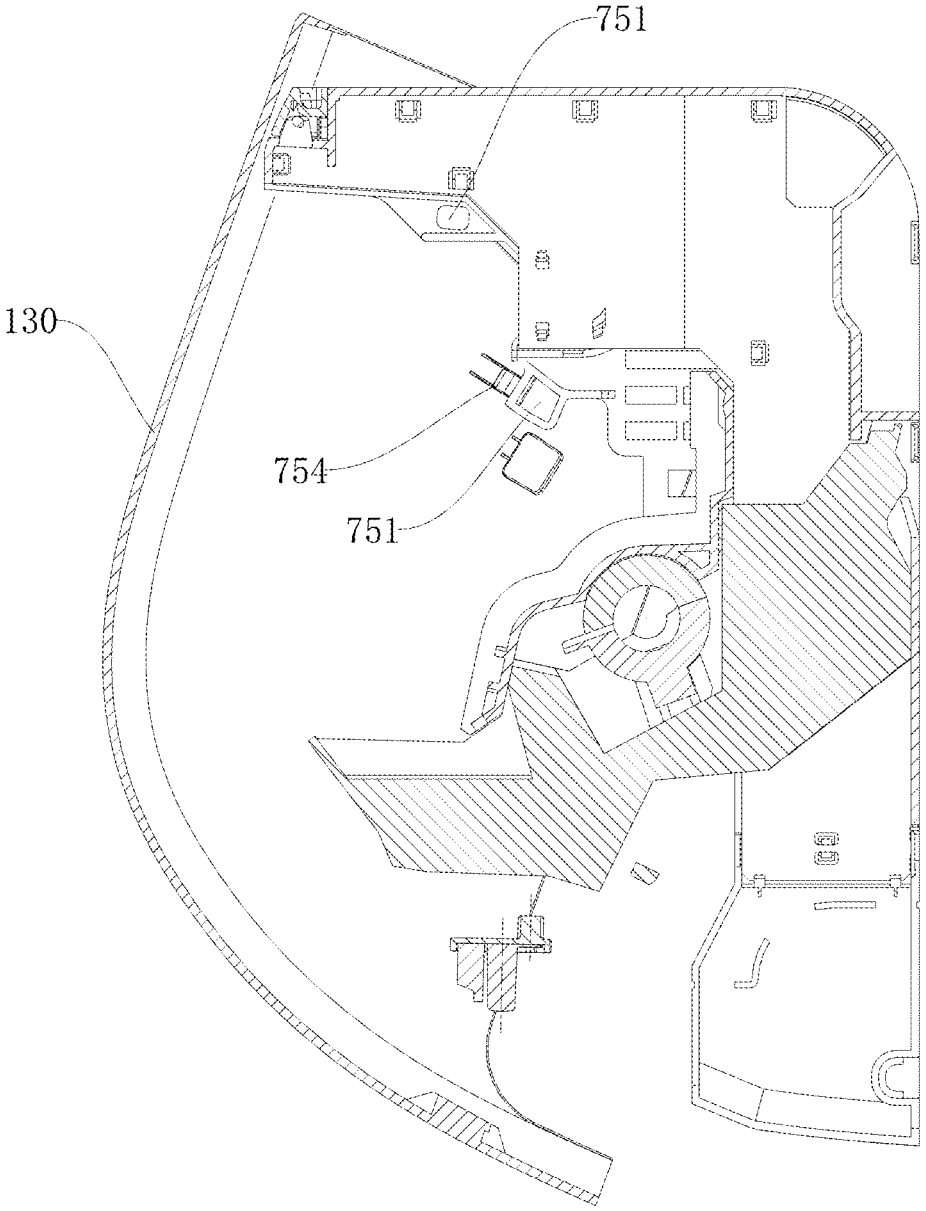
FIG. 19 is a front view of an indoor unit of an air conditioner according to another embodiment of the present invention, in which a front cover is in another open position.

The second positioning block 754 may be fitted with the second positioning hole 751 in many ways. For example, as shown in FIGS. 16 to 18, in some embodiments of the present invention, the second positioning block 754 may be inserted in the second positioning hole 751, and an inner circumferential wall of the second positioning hole 751 may stop and restrict the second positioning block 754, such that the second positioning block 754 may be fixed in the second positioning hole 751. For another example, as shown in FIG. 19, in some other embodiments of the present invention, the second positioning block 754 is no longer inserted in the second positioning hole 751, but abuts against an outer circumferential wall of the second positioning hole 751, in which case the second positioning block 754 may be also stopped and restricted.

It should be noted herein that considering that the second positioning hole 751 is a virtual space instead of a tangible component, the outer circumferential wall of the second positioning hole 751 may refer to an outer circumferential wall of a tangible component that forms the second positioning hole 751 by surrounding, and the inner circumferential wall of the second positioning hole 751 may refer to an inner circumferential wall of the tangible component that forms the second positioning hole 751 by surrounding. For example, as shown in FIGS. 16 to 19, the front cover 130 is provided with an annular structure, and the second positioning hole 751 in formed in a middle portion of the annular structure. The second positioning block 754 may be inserted in the annular structure to abut against an inner wall of the annular structure, or may be located outside the annular structure to abut against an outer circumferential wall of the annular structure.

In an embodiment shown in FIGS. 16 to 18, two second positioning holes 751 are provided and located at different heights. In the processing of pivotably opening the front cover 130, the second positioning block 754 may be inserted in the two second positioning holes 751 sequentially. FIG. 17 is a schematic view showing the front cover 130 at a first positioning angle. In the processing of rotatably opening the front cover 130, the second positioning block 754 slides into a lower one of the two second positioning holes 751 to realize the positioning and fixing of the front cover 130 at the first positioning angle. At this angle, an indoor and outdoor piping space is increased effectively and thus the convenience of piping is improved.

FIG. 18 is a schematic view showing the front cover 130 at a second positioning angle. The front cover 130 continues rotating till reaching the second positioning angle, and then the second positioning block 754 slides into a higher one of the two second positioning holes 751 to realize the positioning and fixing of the front cover 130 at the second positioning angle. In such case, a wiring space is completely exposed to make a wiring operation visualized, thus improving the convenience of wiring considerably.

By providing the plurality of second positioning holes 751 capable of being fitted with the second positioning block 754, it is achievable to fix the front cover 130 at multiple pivoting angles. Consequently, due to the above multistage positioning with multiple positioning angles, the piping and wiring of the wall-hanging air conditioner becomes simple and convenient; moreover, due to the multi-angular positioning, the inside components are fully exposed to improve the convenience of maintaining and repairing components greatly.

With reference to FIGS. 16 to 19, the front cover 130 is pivotably provided over the base plate, the front cover 130 and the base plate each have a substantially L-shaped longitudinal section, and the front cover 130 and the base plate each have a left side wall and a right side wall. Alternatively, the left side wall of the front cover 130 is pivotably connected with the left side wall of the base plate, and the right side wall thereof is pivotably connected with the right side wall thereof. For example, in some embodiments of the present invention, the side wall of the base plate may be provided with a shaft hole, the side wall of the front cover 130 may be provided with a rotary shaft, and the rotary shaft is configured to be rotatably fitted in the shaft hole, such that the front cover 130 can be pivotably disposed to the base plate. This kind of structure is convenient to assemble, and the front cover 130 may pivot flexibly and reliably.

It may be understood that the second positioning block 754 and the second positioning hole 751 may be provided at multiple positions. For example, in some embodiments of the present invention, the second positioning block 754 may be disposed at the side wall of the front cover 130, and the plurality of second positioning holes 751 may be disposed in the side wall of the base plate. Thus, the second positioning block 754 and the second positioning hole 751 have few effects on the structures and appearances of the front cover 130 and the base plate respectively.

To facilitate switching the second positioning block 754 among the plurality of second positioning holes 751, the plurality of second positioning holes 751 in the same side wall of the base plate have respective centers arranged in a circle whose center is located at a pivoting axis of the front cover 130, and each of the plurality of second positioning holes 751 extends along a radial direction of the circle. This structure has a beautiful appearance and a good positioning effect.

Preferably, a pair of second positioning blocks 754 may be provided and disposed at the left side wall and the right side wall of the front cover 130 respectively. Correspondingly, a plurality of pairs of second positioning holes 751 are provided, and each pair of second positioning holes 751 are disposed in the left side wall and the right side wall of the base plate respectively. That is, the front cover 130 may be provided with two second positioning blocks 754, one of the two second positioning blocks 754 is disposed in the left side wall of the front cover 130 and the other one thereof is disposed in the right side wall of the front cover 130. Two groups of second positioning holes 751 are provided, one group of second positioning holes 751 are provided in the left side wall of the base plate, the other group of second positioning holes 751 are provided in the right side wall of the base plate, and the second positioning holes 751 in the left side wall are in one-to-one correspondence with the second positioning holes 10 in the right side wall. That is, the number of the plurality of second positioning holes 751 in the left side wall is equal to that of the plurality of second positioning holes 751 in the right side wall, and positions of the plurality of second positioning holes 751 in the left side wall correspond to those of the plurality of second positioning holes 751 in the right side wall.

When one second positioning block 754 is fitted in a certain second positioning hole 751 in the left side wall, the other second positioning block 754 is fitted in the corresponding second positioning hole 751 in the right side wall. Two second positioning blocks 754 are fitted with two second positioning holes 751 respectively to position and fix a left end and a right end of the front cover 130. Thus, the front cover 130 can be positioned and fixed in various positions with a balanced fixing effect, and hence the front cover 130 can be fixed firmly.

As shown in FIGS. 17 and 18, the base plate is provided with a stopping surface 752, and the second positioning block 754 is stopped by the stopping surface 752 when the front cover 130 closes the base plate. That is, when the front cover 130 is in a closed position, the second positioning block 754 may abut against the stopping surface 752, so as to position the closing of the front cover 130 and stabilize the front cover 130 in the closed position.

Similarly, the front cover 130 may be provided with a stopping block 755 and the base plate may be provided with a stopping groove 753. The stopping block 755 may be stopped in the stopping groove 753 when the front cover 130 closes the base plate. Consequently, the fitting of the stopping block 755 and the stopping groove 753 allows the front cover 130 to be closed accurately and stably.

In an embodiment of the present invention, as shown in FIGS. 1 to 2 and 20 to 23, the heat exchanger 140 and the fan wheel 143 are provided to the base plate. Alternatively, the heat exchanger 140 and the fan wheel 143 are provided to the lower base plate 120. The base plate includes the left end plate and the right end plate each provided with a first pivoting portion 710. A second pivoting portion 720 is provided at each of the left and right ends of the front cover 130. The first pivoting portion 710 at the left side is fitted with the second pivoting portion 720 at the left side while the first pivoting portion 710 at the right side is fitted with the second pivoting portion 720 at the right side, such that the front cover 130 is pivotably provided to the base plate. Specifically, the front cover 130 includes the left panel 133 and the right panel 134, and the left panel 133 is located outside the left end plate of the base plate and the right panel 134 is located outside the right end plate of the base plate.

Alternatively, the second pivoting portion 720 at the left side is located on the left panel 133, while the second pivoting portion 720 at the right side is located on the right panel 134.

Figure 22:
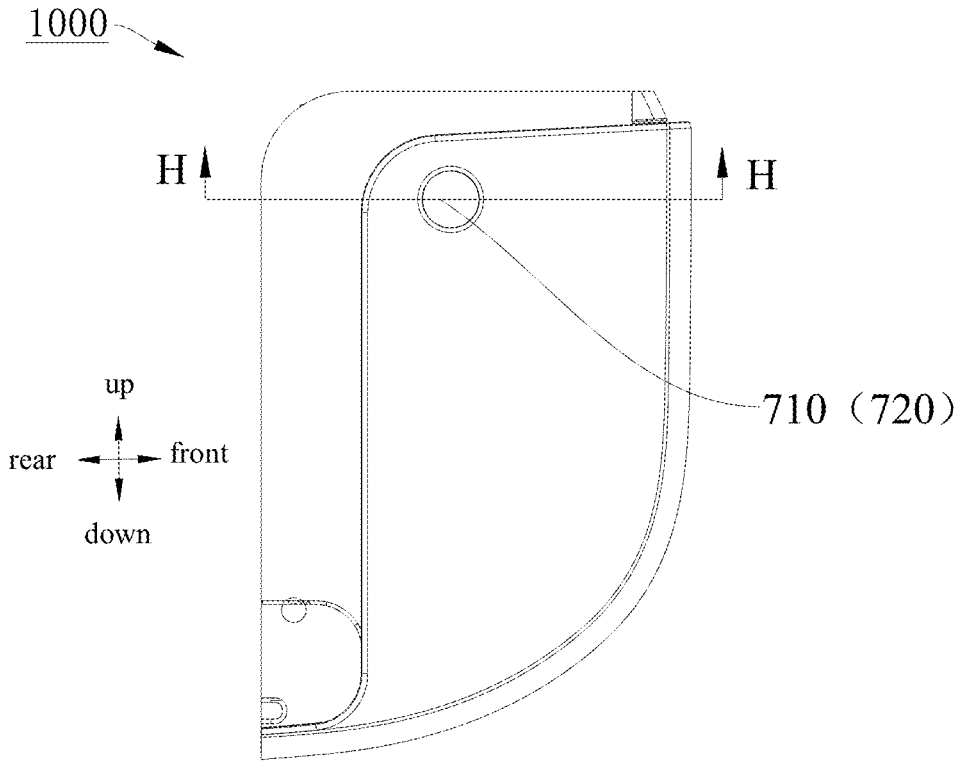
FIG. 22 is a side view of an indoor unit of an air conditioner according to an embodiment of the present invention.

Advantageously, as shown in FIG. 22, the second pivoting portion 720 is located at an upper end of the indoor unit and adjacent to a rear side thereof, such that most components within the indoor unit can be exposed when the front cover 130 is open, thereby facilitating the mounting and dismounting of the internal components.

Figure 21:
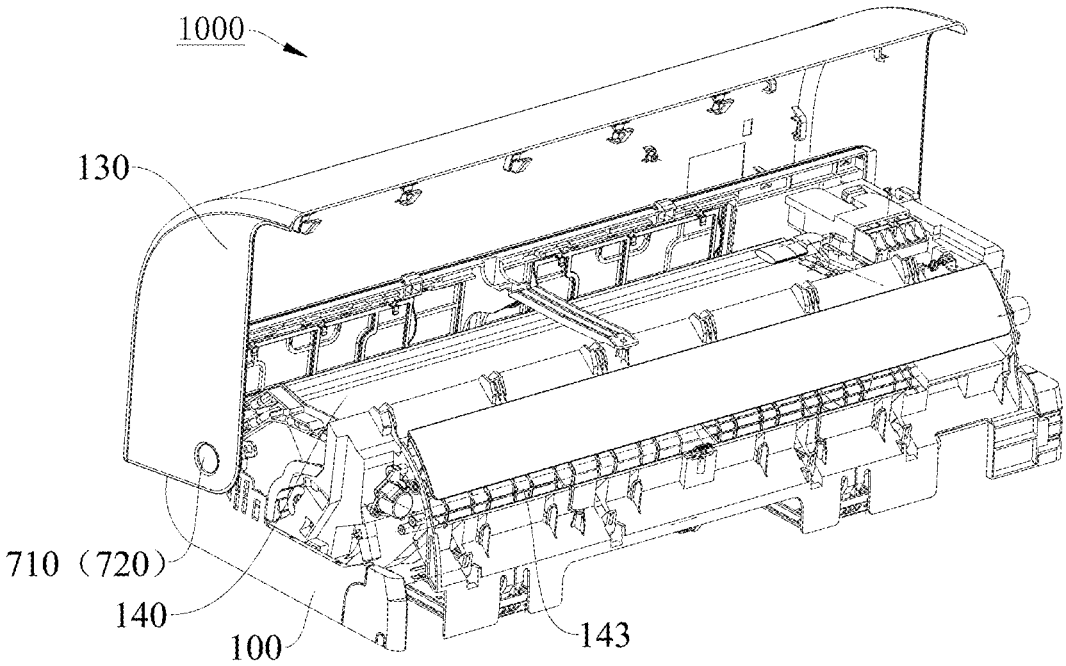
FIG. 21 is a schematic view of an indoor unit according to an embodiment of the present invention, in which a front cover is in an open state.

With the fitting of the first pivoting portion 710 and the second pivoting portion 720, the front cover 130 may be opened rotatably around a pivoting axis of the first pivoting portion 710 and the second pivoting portion 720, and the open state thereof is shown in FIG. 21. In such a way, when the indoor unit needs cleaning, maintenance, repair and replacement of components (like the fan wheel 143 and the heat exchanger 140), an operator may open the front cover 130 directly to implement operations. Compared with the design of the traditional air conditioner where the front cover 130 is divided into the panel and the frame, the traditional air conditioner needs to be provided with more screws and snap structures to fix the panel and the frame. However, in the embodiment of the present invention, since the front cover 130 has an integral structure, there are fewer connection structures between the front cover 130 and the base plate, which greatly improves the assembling efficiency of the indoor unit along with the improved production efficiency, and brings much convenience to repairing the component.

In a specific example, a threaded connection structure or another snap structure may be further provided between the base plate and the front cover 130. When the front cover 130 is in the closed state, the base plate and the front cover 130 may be connected together via the threaded connection structure or the snap structure. Certainly, the front cover 130 may also remain in the closed state by its own gravity alone, which will not be limited specifically.

In the indoor unit according to the embodiment of the present invention, the front cover 130 is pivotably connected to the base plate via the fitting between the first pivoting portion 710 and the second pivoting portion 720, which sharply reduces the number of connection structures (such as threaded fasteners or snaps) between the base plate and the front cover 130 and improves the production efficiency of the indoor unit. Moreover, the whole front cover 130 is rotatable with respect to the base plate, which facilitates the cleaning, maintenance, repair and replacement of internal components of the indoor unit, and greatly improves the convenience of using the indoor unit and the maintainability thereof.

Figure 23:
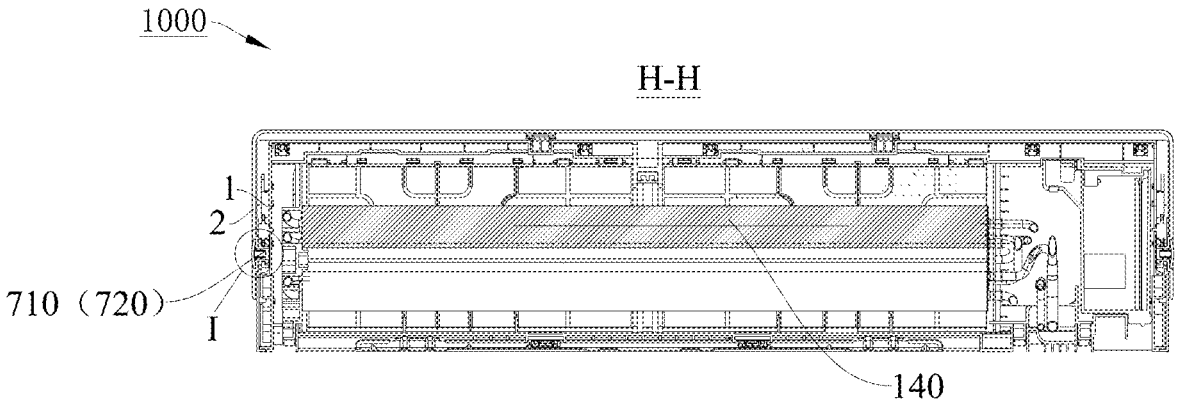
FIG. 23 is a sectional view of the indoor unit along direction H-H in FIG. 22.
Figure 24:
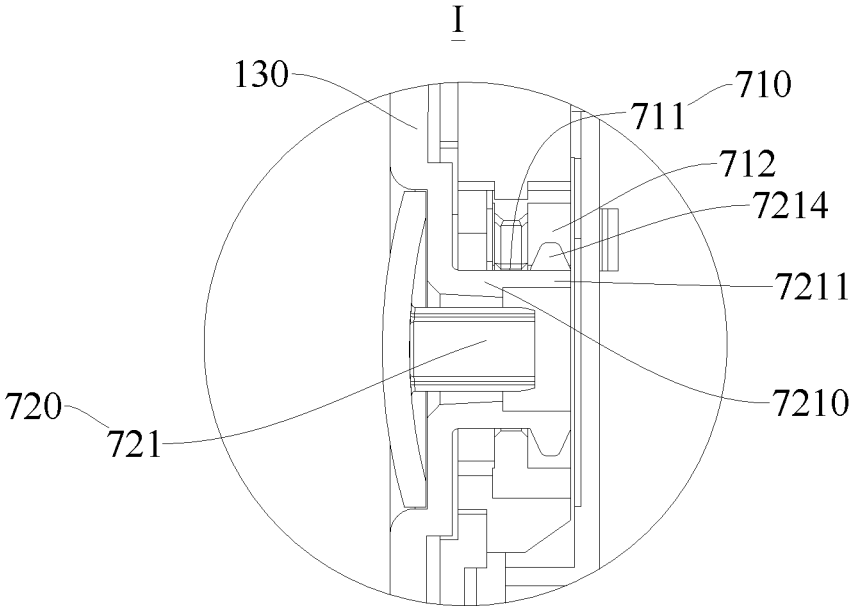
FIG. 24 is an enlarged view of part I in FIG. 23.

In some embodiments of the present invention, as shown in FIGS. 22 to 24, the first pivoting portion 710 includes a pivot hole 711, while the second pivoting portion 720 includes a pivoting shaft 721, such that the first pivoting portion 710 and the second pivoting portion 720 have simple structures, are easy to process and convenient to assemble. Certainly, the present invention is not limited thereby. The first pivoting portion 710 may include the pivoting shaft 721, while the second pivoting portion 720 may include the pivot hole 711.

In some specific embodiments, as shown in FIG. 24, an elastically deformable snapping member 7211 is provided to an outer circumferential wall of the pivoting shaft 721, a snapping groove 712 is provided in the pivot hole 711, and the snapping member 7211 is configured to be fitted in the snapping groove 712. Consequently, it is possible to prevent the pivoting shaft 721 from falling off the pivot hole 711 and improve the reliability of connecting the panel and the base plate. Herein, the snapping member 7211 may be elastically deformed, so that it is convenient for the snapping member 7211 to be inserted into the snapping groove 712.

Specifically, as shown in FIG. 24, the pivoting shaft 721 is configured as a hollow sleeve 7210, and two snapping members 7211 are provided symmetrically along an outer circumferential wall of the sleeve 7210. A protrusion 7214 is provided at an outer side of a free end of the snapping member 7211 and is configured to be received in the snapping groove 712. More specifically, as shown in FIG. 24, the free end of the snapping member 7211 goes beyond a free end of the sleeve 7210 in a radial direction of the pivoting shaft 721, so as to facilitate deformation of the snapping member 7211 to snap the protrusion 7214 on the snapping member 7211 into the snapping groove 712 smoothly.

Figure 25:
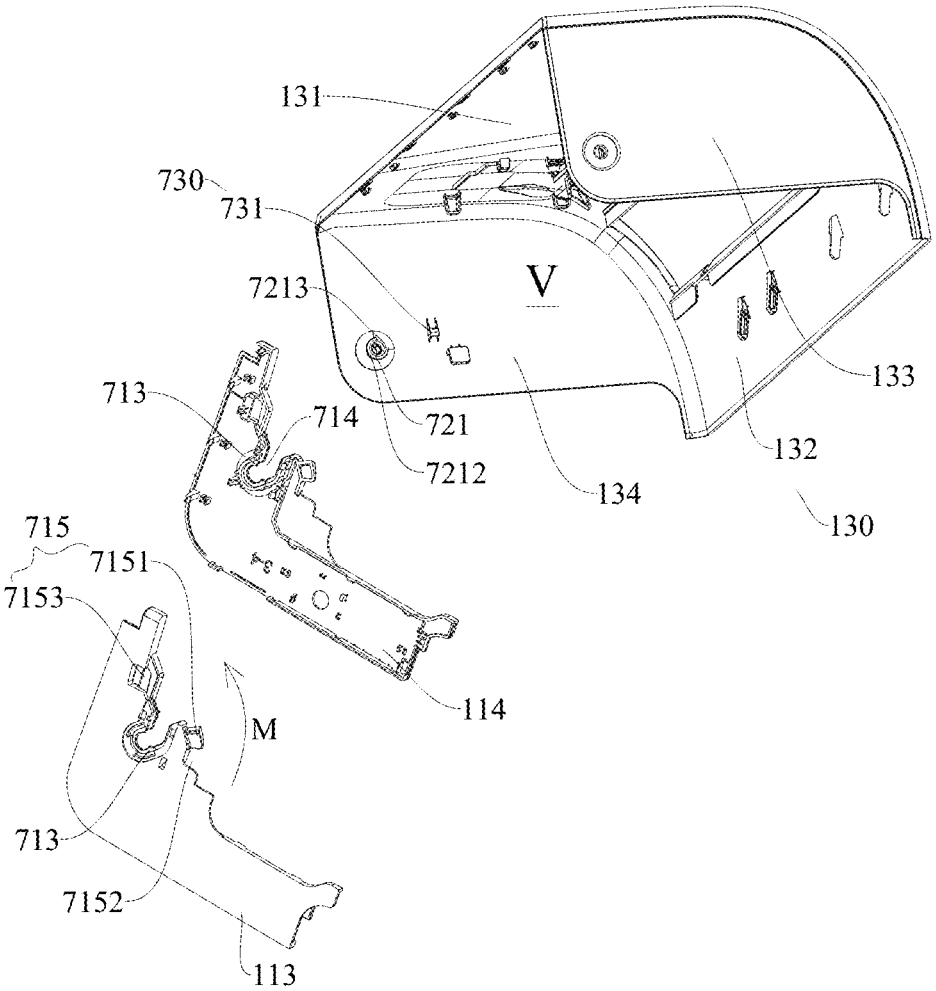
FIG. 25 is an exploded view of a front cover, and a left end plate and a right end plate of a base plate according to an embodiment of the present invention.

In some other specific embodiments, as shown in FIG. 25, an annular flange 7212 is provided on an outer circumferential wall of a free end of the pivoting shaft 721, and an annular stopping convex rib is provided on a circumferential wall of the pivot hole 711 and configured to be fitted with the annular flange 7212, so as to limit a degree of freedom of the pivoting shaft 721 in the left and right direction.

The stopping convex ribs at both sides of the base plate abut against the annular flanges 7212 of the pivoting shafts 721 at two ends of the front cover 130 respectively, and the annular flange 7212 is located at an inner side of the corresponding stopping convex rib. That is, the stopping convex ribs at both sides of the base plate clamp the front cover 130 from the left and right sides respectively. In such a way, the fitting between the annular flange 7212 and the stopping convex rib may prevent the front cover 130 from shaking in the left and right direction, and also prevent the pivoting shaft 721 from falling off the pivot hole 711, so as to improve the connection reliability of the panel and the base plate. The stopping convex rib is configured to surround an outer periphery of the pivot hole 711, so as to allow the stopping convex rib to limit the annular flanges 7212 more stably. Alternatively, the stopping convex rib may be annular, and thus the stopping convex rib may be better fitted with the annular flange 7212.

Specifically, as shown in FIG. 25, at least part of an edge of the annular flange 7212 is configured as a demoulding plane 7213. In other words, the annular flange 7212 has a notch, such that the panel may be easily demoulded at the annular flange 7212 when the panel is manufactured.

Further, as shown in FIG. 25, a guiding groove 714 is provided between the pivot hole 711 and the left panel 133 and/or between the pivot hole 711 and the right panel 134. The pivoting shaft 721 may slidably enter the pivot hole 711 along the guiding groove 714, such that it is convenient for the pivoting shaft 721 to be fitted with the left panel 133 and/or the right panel 134.

The guiding groove 714 includes at least two segments of grooves extending in directions with an included angle therebetween, i.e., a direction in which a segment of groove extends has an included angle with respect to another direction in which another segment of groove extends, such that when the pivoting shaft 721 slides in the guiding groove 714 till getting fitted in the pivot hole 711, the pivoting shaft 721 may be limited by the guiding groove 714 so as to be prevented from falling off the guiding groove 714. Moreover, the user experience may be upgraded during the rotation of the pivoting shaft 721.

Alternatively, as shown in FIG. 24, an inner wall of at least one of the left panel 133 and the right panel 134 is provided with a reinforcing rib surrounding the pivot hole 711 and extending inwards. The reinforcing rib protrudes inwards from the inner wall of the at least one of the left panel 133 and the right panel 134. When the at least one of the left panel 133 and the right panel 134 is mounted in place, the reinforcing rib may be used to prevent the deformation of the pivot hole 711 when the pivot hole 711 is fitted with the pivoting shaft 721. Moreover, the reinforcing rib may extend to the edge of the at least one of the left panel and the right panel, and abut against a structure adjacent to the at least one of the left panel 133 and the right panel 134 to assist in the mounting of the at least one of the left panel 133 and the right panel 134.

An elastic relief groove is provided between the reinforcing rib and a body structure of the at least one of the left panel 133 and the right panel 134. Thus, in the process of mounting the pivoting shaft 721 into the pivot hole 711, the pivoting shaft 721 may be mounted in place more conveniently.

Alternatively, an outer wall of at least one of the left panel 133 and the right panel 134 is provided with a supporting member, and the supporting member supports the pivoting shaft 721 when the pivoting shaft 721 is fitted in the pivot hole 711. By providing the supporting member, the mounting of the pivot hole 711 is further reinforced.

In some embodiments, as shown in FIGS. 25 to 28, the left panel 133 or the right panel 134 of the front cover 130 is provided a first limiting member 730, and the left end plate or the right end plate of the base plate (specifically the upper base plate) is provided with a plurality of second limiting members 715 spaced apart from one another. The first limiting member 730 is configured to be fitted with the plurality of second limiting members 715, so as to position the front cover 130 at different opening angles. Therefore, when the operator needs to open the front cover 130, the front cover 130 may be positioned at a desired opening angle based on practical situations, thereby improving the convenience of using and maintaining the indoor unit.

Figure 27:
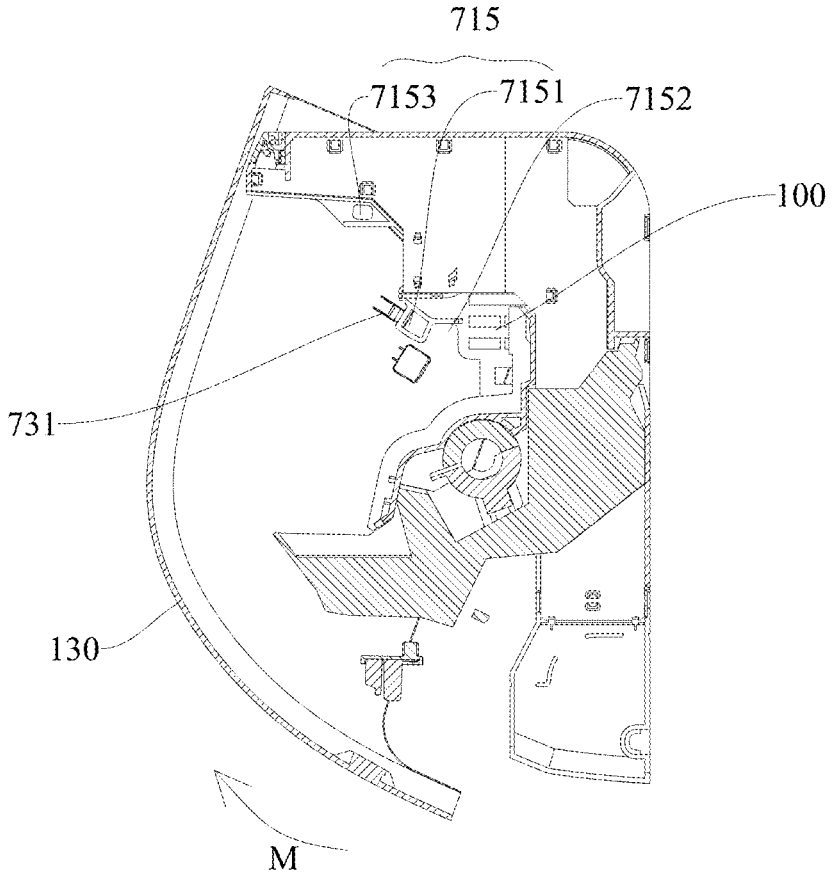
FIG. 27 is a sectional view of an indoor unit according to an embodiment of the present invention, in which a front cover is opened by an opening angle of 20 degrees.
Figure 28:
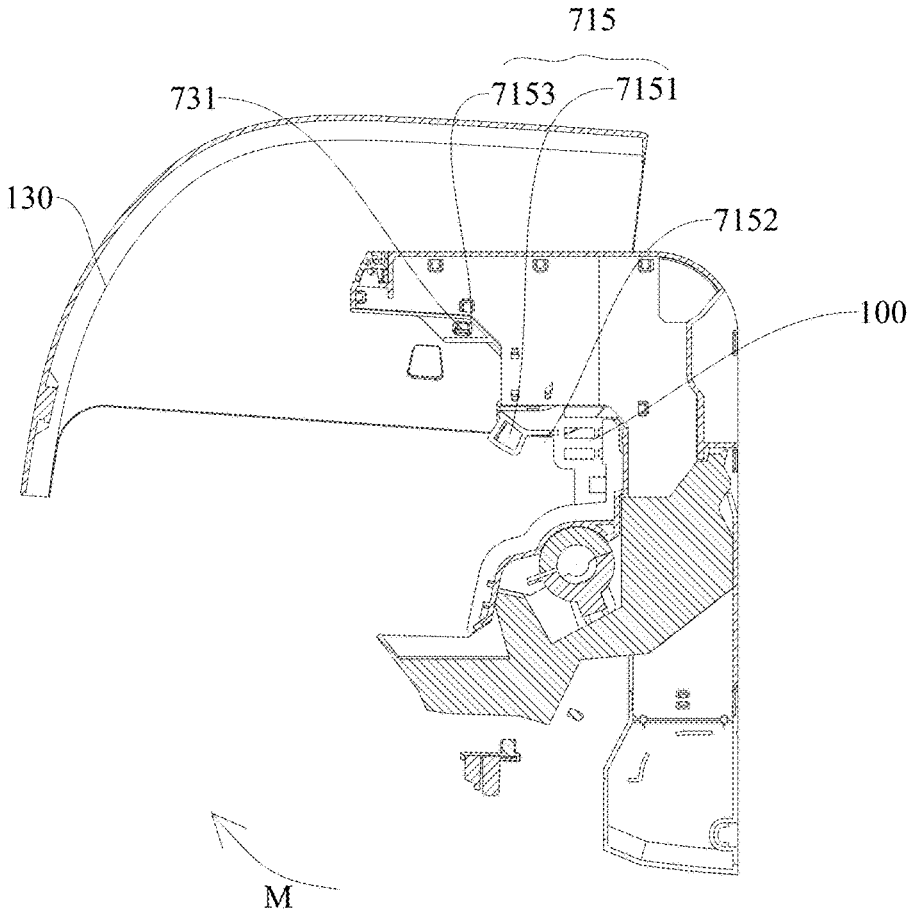
FIG. 28 is a sectional view of an indoor unit according to an embodiment of the present invention, in which a front cover is opened by an opening angle of 94 degrees.

For example, when the operator only wants to check the wiring or piping situation at the bottom of the indoor unit, the operator may open the front cover 130 to an opening angle of 20 degrees, as shown in FIG. 27. When the operator wants to dismount the fan wheel 143, the operator may open the front cover 130 to an opening angle of 94 degrees, as shown in FIG. 28.

The first limiting member 730 and the second limiting member 715 may have various kinds of structures, which will not be limited herein. For example, the first limiting member 730 is configured as a hook, the second limiting member 715 is configured as a limiting step 7151 or a limiting hole 7153, and the hook is configured to be fitted with the limiting step 7151 or the limiting hole 7153. For another example, the first limiting member 730 is configured as a first positioning block 731, the second limiting member 715 is configured as a limiting step 7151 or a limiting hole 7153, and the first positioning block 731 is configured to be fitted with the limiting step 7151 or the limiting hole 7153.

In a specific example shown in FIGS. 25 to 28, the first limiting member 730 is configured as the first positioning block 731, and two second limiting members 715 corresponding to the first limiting member 730 are provided, in which one second limiting member 715 is configured as the limiting step 7151 and the other second limiting member 715 is configured as the limiting hole 7153. In a direction M of opening the front cover 130, the limiting step 7151 is located at the upstream of the limiting hole 7153. In this example, the front cover 130 may be positioned at at least two opening angles.

Figure 26:
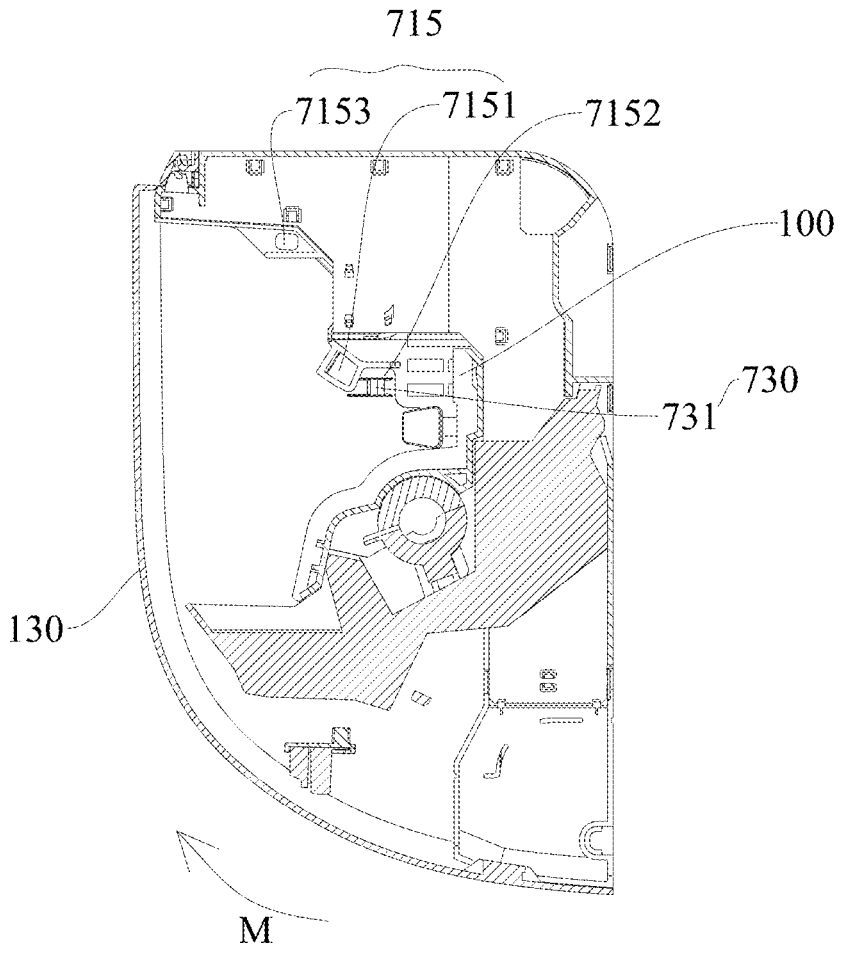
FIG. 26 is a sectional view of an indoor unit according to an embodiment of the present invention, in which a front cover is in a closed state.

As shown in FIG. 26, a limiting gap 7152 is defined between the limiting step 7151 and the rest part of the base plate. When the front cover 130 is in the closed state, the first positioning block 731 is stuck in the limiting gap 7152. As shown in FIG. 27, when the front cover 130 is opened by a small angle, the first positioning block 731 is stuck at the limiting step 7151, and more specifically at the upstream of the limiting step 7151 in the direction M of opening the front cover 130. As shown in FIG. 28, when the front cover 130 is opened by a big angle, the first positioning block 731 is fitted in the limiting hole 7153, such that the front cover 130 may remain still in the open state with the big angle, so as to prevent a sudden closing of the front cover 130 when the indoor unit shakes.

In some embodiments, as shown in FIGS. 1 and 2, the base plate includes the upper base plate 110 and the lower base plate 120. The heat exchanger 140 is disposed to the upper base plate 110, and the front cover 130 is pivotably disposed to the lower base plate 120. The lower base plate 120 is detachably disposed to a lower portion of the upper base plate 110, and the fan wheel 143 is disposed to the lower base plate 120.

By mounting the fan wheel 143 to the lower base plate 120 and detachably mounting the lower base plate 120 to the upper base plate 110, the cleaning, maintenance, repair and replacement of the fan wheel 143 only needs to open the front cover 130 and detach the lower base plate 120 from the upper base plate 110. In such a way, the fan wheel 143 may be dismounted from the indoor unit, which avoids the problem in the related art that the heat exchanger 140 affects the mounting and dismounting of the fan wheel 143.

The cleaning of the fan wheel 143 does not involve the dismounting and mounting of the heat exchanger 140, which thus avoids the problem that the heat exchanger 140 tends to break down due to the dismounting and mounting thereof, thereby facilitating the maintenance of the indoor unit and reducing the failure rate of the indoor unit.

Specifically, as shown in FIG. 3, the upper base plate 110 is provided with the air inlet grille 117, and the air inlet grille 117 defines the air inlet 101. That is, the air inlet grille 117 is integrally formed in the upper base plate 110, thereby enhancing the structural strength of the air inlet grille 117 and facilitating the molding of the upper base plate 110.

Specifically, as shown in FIGS. 1 to 4 and FIG. 25, the front cover 130 defines the covering chamber V, and the upper base plate 110 and the lower base plate 120 are disposed in the covering chamber V and covered by the front cover 130, such that the indoor unit has a beautiful appearance and provides an enclosed space therein, thus facilitating the oriented air supply.

In some specific embodiments, as shown in FIG. 25, the front cover 130 further includes the front panel 131 and the lower panel 132. The front panel 131 covers front surfaces of the upper base plate 110 and the lower base plate 120. The lower panel 132 has the front edge connected with the lower edge of the front panel 131, and covers the lower surface of the lower base plate 120. The left panel 133 has the front edge connected with the left edge of the front panel 131 and the lower edge connected with the left edge of the lower panel 132, and covers the left side of the upper base plate 110. The right panel 134 has the front edge connected with the right edge of the front panel 131 and the lower edge connected with the right edge of the lower panel 132, and covers the right side of the upper base plate 110.

Figure 20:
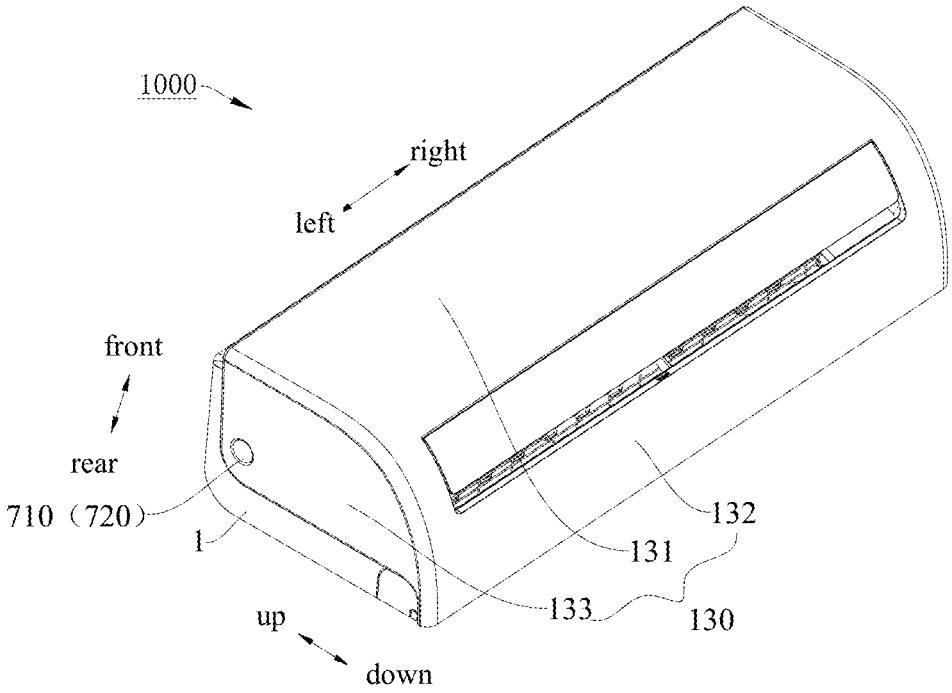
FIG. 20 is a perspective view of an indoor unit of an air conditioner according to an embodiment of the present invention, in which a front cover is in a closed state.

Specifically, as shown in FIG. 20, the front panel 131 and the lower panel 132 are connected via the arc transition portion, to further improve the aesthetics of the indoor unit. Moreover, the arc transition portion between the front panel 131 and the lower panel 13 improves the structural strength of the front cover 130 and is convenient to be molded.

Figure 29:
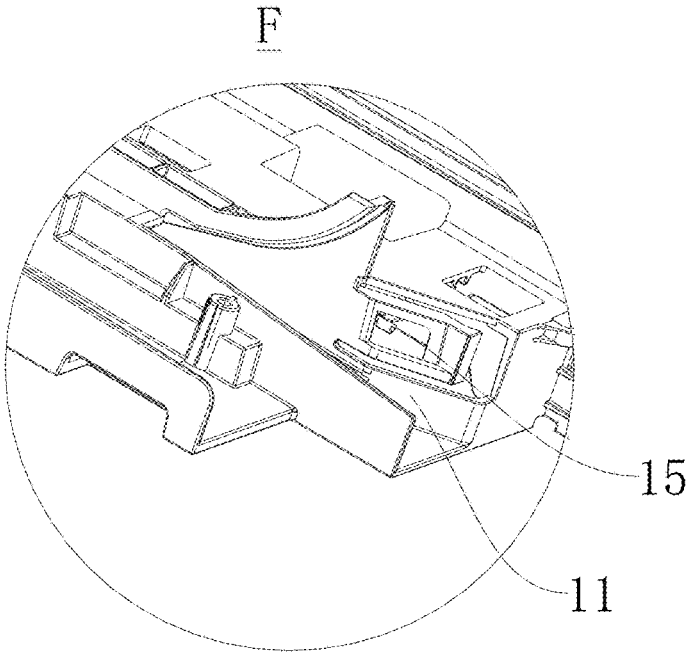
FIG. 29 is an enlarged view of part F in FIG. 1.
Figure 30:
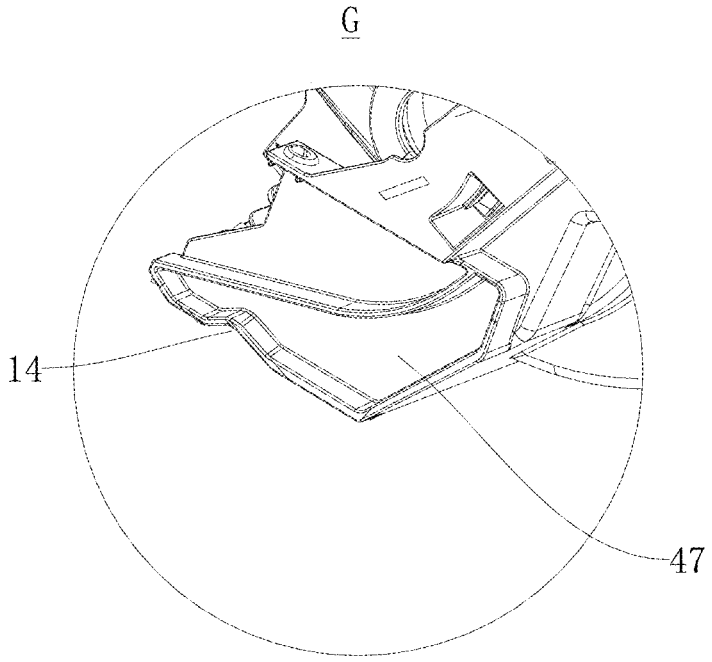
FIG. 30 is an enlarged view of part G in FIG. 1.

In some embodiments, as shown in FIGS. 29 and 30, the indoor unit 1000 further includes a guide assembly for guiding the lower base plate 120 in the process of mounting and dismounting the lower base plate 120. The guide assembly includes a guide groove and a guide rail. The guide groove is provided in the upper base plate 110, and the guide rail is disposed on the lower base plate 120 and configured to be fitted with the guide groove. In such a way, when the upper base plate 110 and the lower base plate 120 are assembled, the guide rail of the lower base plate 120 may be inserted along the guide groove of the upper base plate 110, thus facilitating the positioning and mounting of the upper base plate 110 and the lower base plate 120. Moreover, the fitting of the guide rail and the guide groove may improve the connection strength between the upper base plate 110 and the lower base plate 120.

Preferably, the guide rail is provided at each of a left end face and a right end face of the lower base plate 120, and the guide groove of the upper base plate 110 is provided in the corresponding manner.

Specifically, a limiting protrusion is provided in the guide groove, the guide rail is provided with a limiting groove, and the limiting protrusion is configured to be fitted in the limiting groove. In such a way, in the process of inserting the guide rail into the guide groove, when the limiting protrusion is stuck in the limiting groove, it indicates that the guide rail is inserted to a mounting position, i.e. the upper base plate 110 and the lower base plate 120 are assembled in place, thereby further facilitating the positioning of the lower base plate 120 and the upper base plate 110.

Further, the upper base plate 110 is provided with a connecting groove, the lower base plate 120 is provided with a connecting protrusion, and the connecting protrusion is configured to be fitted in the connecting groove, so as to further position the lower base plate 120.

In a specific example of the present invention, the connecting protrusion is provided on the left end face or the right end face of the lower base plate 120. An elastic plate is provided at a corresponding end of the upper base plate 110, and the connecting groove is provided in the elastic plate. When the lower base plate 120 is mounted upwards to the upper base plate 110, the end face or the connecting protrusion of the lower base plate 120 touches and jacks up the elastic plate, and thus the elastic plate is deformed in a direction moving away from the lower base plate 120. When the lower base plate 120 is assembled in place, the connecting protrusion is snapped into the connecting groove, and the elastic plate is restored, such that the lower base plate 120 is fixed to the upper base plate 110.

Further, the lower base plate 120 is further mounted to the upper base plate 110 via a threaded fastener. That is, the lower base plate 120 is connected to the upper base plate 110 via the threaded fastener (like a screw), besides the above snap structure, which guarantees the fastness of connecting the upper base plate 110 with the lower base plate 120 and improves the safety of using the indoor unit 1000.

Certainly, since the above snap structure is provided between the upper base plate 110 and the lower base plate 120, the number of the fasteners (like the screw) for connecting the upper base plate 110 with the lower base plate 120 may be reduced, which decreases the operation time considerably when the lower base plate 120 needs dismounting.

In some specific embodiments of the present invention, with reference to FIGS. 29 and 30, the indoor unit 1000 may include a guide assembly for guiding the lower base plate 120 in the process of mounting and dismounting the lower base plate 120. The guide assembly includes a guide groove 11 and a guide rail 12 fitted with the guide groove 11. The guide groove 11 is provided in the upper base plate 110, and the guide rail 12 is disposed on the lower base plate 120. Further, the guide groove 11 may be provided with a limiting protrusion therein, the guide rail 12 may be provided with a limiting groove 14, and the limiting protrusion is configured to be fitted in the limiting groove 14. Through the fitting of the guide groove 11 and the guide rail 12, the upper base plate 110 and the lower base plate 120 may mounted or dismounted conveniently. Through the fitting of the limiting protrusion and the limiting groove 14, the guide rail 12 and the guide groove 11 are limited by each other to improve the mounting stability of the upper base plate 110 and the lower base plate 120.

Alternatively, with reference to FIGS. 29 and 30, the upper base plate 110 may be provided with a connecting groove 15, the lower base plate 120 may be provided with a connecting protrusion, and the connecting protrusion is configured to be fitted in the connecting groove 15, such that it is convenient to mount and dismount the upper base plate 110 and the lower base plate 120, along with the improved mounting stability.

Other configurations and operations of the indoor unit 1000 according to embodiments of the present invention are known to those skilled in the art, which will not be elaborated herein.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation or position as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "specific examples" or "some examples" means that a particular feature, structure, material, or characteristic described in connection with the embodiment or example is included in at least one embodiment or example of the present invention. Thus, the appearances of the above phrases throughout this specification are not necessarily referring to the same embodiment or example of the present invention. Furthermore, the particular features, structures, materials, or characteristics may be combined in any suitable manner in one or more embodiments or examples. Those skilled in the art can integrate and combine different embodiments or examples and the features in different embodiments or examples in the specification.

Although embodiments of the present invention have been shown and illustrated, it shall be understood by those skilled in the art that various changes, modifications, alternatives and variants without departing from the principle and spirit of the present invention are acceptable. The scope of the present invention is defined by the claims or the like.

What is claimed is:

1. An indoor unit for an air conditioner, comprising:

a housing comprising an upper base plate provided with an air inlet, a lower base plate detachably mounted to the upper base plate and provided with an air outlet, and a front cover detachably mounted to the upper base plate and positioned to the lower base plate via a snap assembly, the snap assembly including:

a snap disposed on an inner wall of the front cover and including:

an upper snap protruding from the inner wall of the front cover; and a lower snap protruding from the inner wall of the front cover and disposed below the upper snap, a first spacing being formed between the upper snap and the lower snap in a first direction; and a snapping portion disposed on the lower base plate, the snapping portion including:

a base portion protruding from the lower base plate and being configured to be clamped in the first spacing between the upper snap and the lower snap in the first direction; and a left side wall and a right side wall protruding from a left end and a right end of the base portion, respectively, the left side wall comprising a left plate and the right side wall comprising a right plate, the left plate and the right plate being parallel to the first direction and parallel to each other, the left side wall and the right side wall each having a proximal end connected to the base portion and a distal end away from the base portion, the distal end of the left side wall and the distal end of the right side wall being spaced away from and not connected to each other, a second spacing being formed between the left side wall and the right side wall in a second direction perpendicular to the first direction and being configured to clamp and limit the upper snap in the second direction;

a heat exchanger mounted to the upper base plate; and a fan detachably mounted to the lower base plate.

2. The indoor unit according to claim 1, wherein the upper base plate comprises:

a rear baffle, the heat exchanger being disposed to the rear baffle;

an upper cover plate having a rear edge connected with an upper edge of the rear baffle, the air inlet being formed in the upper cover plate;

a left end plate having a rear edge connected with a left edge of the rear baffle and an upper edge connected with a left edge of the upper cover plate; and a right end plate having a rear edge connected with a right edge of the rear baffle and an upper edge connected with a right edge of the upper cover plate, wherein the lower base plate is detachably mounted at a right side of the left end plate and at a left side of the right end plate, the left end plate is located at a left side of the lower base plate and the right end plate is located at a right side thereof.

3. The indoor unit according to claim 2, wherein the upper base plate further comprises:

a left shield plate mounted at a left side of the left end plate; and a right shield plate mounted at a right side of the right end plate, wherein the front cover is detachably mounted to the left shield plate and the right shield plate.

4. The indoor unit according to claim 1, wherein the front cover is pivotably mounted to the upper base plate.

5. The indoor unit according to claim 1, wherein the front cover defines a covering chamber, the upper base plate and the lower base plate are disposed in the covering chamber and covered by the front cover, and the front cover is provided with an air supply port corresponding to the air outlet in terms of position.

6. The indoor unit according to claim 5, wherein the front cover comprises:

a front panel configured to cover front surfaces of the upper base plate and the lower base plate;

a lower panel having a front edge connected with a lower edge of the front panel, and configured to cover a lower surface of the lower base plate, the air supply port being provided at a position where the front panel and the lower panel are connected;

a left panel having a front edge connected with a left edge of the front panel and a lower edge connected with a left edge of the lower panel, rotatably mounted to a left side of the upper base plate and configured to cover the left side thereof; and a right panel having a front edge connected with a right edge of the front panel and a lower edge connected with a right edge of the lower panel, rotatably mounted to a right side of the upper base plate and configured to cover the right side thereof.

7. The indoor unit according to claim 1, wherein the lower base plate comprises a front end plate; the snapping portion is formed at an upper edge of the front end plate of the lower base plate; the upper snap is configured to be fitted with a rear wall of the snapping portion; and the lower snap is configured to be fitted with a front wall of the snapping portion.

8. The indoor unit according to claim 7, wherein the upper snap comprises an extension part obliquely extending downwards from front to rear, and the extension part is configured to be fitted with the rear wall of the snapping portion.

9. The indoor unit according to claim 7, wherein at least a part of the front end plate protrudes forwards to form the snapping portion.

10. The indoor unit according to claim 1, wherein a distance between the left side wall and the right side wall of the snapping portion is equal to or larger than a size of the upper snap in a left and right direction.

11. The indoor unit according to claim 1, wherein the front cover is provided with a second positioning block, the upper base plate is provided with a plurality of second positioning holes in different positions and the second positioning block is configured to be fitted with the plurality of second positioning holes in different positions to position the front cover in a state of opening the upper base plate at different opening angles.

12. The indoor unit according to claim 11, wherein the second positioning block is disposed at a side wall of the front cover, and the plurality of second positioning holes are formed in a side wall of the upper base plate.

13. The indoor unit according to claim 12, wherein the plurality of second positioning holes in a same side wall of the upper base plate have respective centers arranged in a circle whose center is located at a pivoting axis of the front cover, and each of the plurality of second positioning holes extends along a radial direction of the circle.

14. The indoor unit according to claim 12, wherein a pair of second positioning blocks are provided and disposed at a left side wall and a right side wall of the front cover respectively, a plurality of pairs of second positioning holes are provided, and each pair of second positioning holes are formed in a left side wall and a right side wall of the upper base plate respectively.

15. The indoor unit according to claim 1, wherein the front cover comprises a left panel and a right panel, and the left panel is located outside a left end plate of the upper base plate and the right panel is located outside a right end plate of the upper base plate;

a second pivoting portion is provided at each of a left end and a right end of the front cover, and a first pivoting portion is provided at each of the left end plate and the right end plate of the upper base plate, in which the first pivoting portion at the left end plate is configured to be fitted with the second pivoting portion at the left end of the front cover while the first pivoting portion at the right end plate is configured to be fitted with the second pivoting portion at the right end of the front cover, such that the front cover is pivotably provided to the upper base plate.

16. The indoor unit according to claim 15, wherein the second pivoting portion at the left end of the front cover is disposed at the left panel, while the second pivoting portion at the right end of the front cover is disposed at the right panel.

17. The indoor unit according to claim 15, wherein the second pivoting portion is located at an upper end of the indoor unit and adjacent to a rear side of the indoor unit.

18. The indoor unit according to claim 16, wherein the first pivoting portion is configured as a pivot hole, while the second pivoting portion is configured as a pivoting shaft.

19. The indoor unit according to claim 18, wherein an elastically deformable snapping member is provided to an outer circumferential wall of the pivoting shaft, a snapping groove is provided in the pivot hole, and the snapping member is configured to be fitted in the snapping groove.

20. The indoor unit according to claim 18, wherein an annular flange is provided on an outer circumferential wall of a free end of the pivoting shaft, an annular stopping convex rib is provided on a circumferential wall of the pivot hole, and the annular stopping convex rib is configured to be fitted with the annular flange to limit a degree of freedom of the pivoting shaft in a left and right direction.

21. The indoor unit according to claim 20, wherein at least part of an edge of the annular flange is configured as a demoulding plane.

22. The indoor unit according to claim 18, wherein an inner wall of at least one of the left panel and the right panel is provided with a reinforcing rib surrounding the pivot hole and extending inwards, an outer wall of at least one of the left panel and the right panel is provided with a supporting member, and the supporting member is configured to support the pivoting shaft when the pivoting shaft is fitted in the pivot hole.

23. The indoor unit according to claim 22, wherein an elastic relief groove is provided between the reinforcing rib and a body structure of the at least one of the left panel and the right panel.

24. The indoor unit according to claim 18, wherein a guiding groove is provided between the pivot hole and an edge of the at least one of the left panel and the right panel, and the pivoting shaft is configured to slidably enter the pivot hole along the guiding groove.

25. The indoor unit according to claim 24, wherein the guiding groove includes at least two segments of grooves extending in directions with an included angle therebetween, and the reinforcing rib extends to the edge of the at least one of the left panel and the right panel.

26. The indoor unit according to claim 15, wherein the left panel or the right panel of the front cover is provided a first limiting member, the left end plate or the right end plate of the upper base plate is provided with a plurality of second limiting members spaced apart from one another, and the first limiting member is configured to be fitted with the plurality of second limiting members to position the front cover at different opening angles.

* * * * *